US007325361B2

(12) United States Patent
Rogers, Jr. et al.

(10) Patent No.: US 7,325,361 B2
(45) Date of Patent: Feb. 5, 2008

(54) APPARATUS AND METHOD FOR PROVIDING A MODULAR SLIDING DOOR MECHANISM

(75) Inventors: Lloyd W. Rogers, Jr., Shelby Township, MI (US); Brian Orr, Chesterfield Township, MI (US); Jeff S. Hamminga, Warren, MI (US); Theodore J. Lindsay, Shelby Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 144 days.

(21) Appl. No.: 10/798,733

(22) Filed: Mar. 11, 2004

(65) Prior Publication Data

US 2004/0221511 A1 Nov. 11, 2004

Related U.S. Application Data

(60) Provisional application No. 60/455,989, filed on Mar. 19, 2003.

(51) Int. Cl.
*E05F 11/00* (2006.01)

(52) U.S. Cl. ..... 49/360; 296/155

(58) Field of Classification Search ..... 49/360; 296/155

See application file for complete search history.

(56) References Cited

U.S. PATENT DOCUMENTS

| | | | | |
|---|---|---|---|---|
| 3,653,154 A | 4/1972 | Hayday | 49/280 |
| 4,121,382 A | 10/1978 | Dietrich et al. | 49/334 |
| 4,163,432 A | 8/1979 | Hertfelder | 123/102 |
| 4,184,577 A | 1/1980 | Miller | 192/84 C |
| 4,191,068 A | 3/1980 | Jardin et al. | 74/625 |
| 4,223,927 A | 9/1980 | Kobayashi et al. | 292/1 |
| 4,247,001 A | 1/1981 | Weigner | 206/222 |
| 4,281,475 A | 8/1981 | Spadoni-Censi | 49/28 |
| 4,285,421 A | 8/1981 | Halsted | 192/84 C |
| 4,462,185 A | 7/1984 | Shibuki et al. | 49/218 |
| 4,530,185 A | 7/1985 | Moriya et al. | 49/280 |

(Continued)

FOREIGN PATENT DOCUMENTS

DE 3526761 A 2/1986

(Continued)

OTHER PUBLICATIONS

A brochure published by Toyota Co. Ltd. regarding the Granvia vehicle, Aug. 1995, pp. 53-62.

*Primary Examiner*—Jerry Redman
(74) *Attorney, Agent, or Firm*—Patrick M. Griffin

(57) ABSTRACT

A modular drive assembly for a sliding door, comprising: a guide track having a hinge slidably received therein; a pair of pulleys disposed on either end of the guide track; a pair of cables each having an end that is secured to the hinge and the other end is secured to a cable drum of a motor drive unit mounted to the guide track, the motor drive unit being configured to rotate the cable drum, wherein the cable drum is also capable of freely rotating within the motor drive unit when the motor drive unit is not rotating the cable drum, wherein rotation of the cable drum causes the hinge to move in the guide track as one of the cables wraps onto the cable drum while the other one of the cables wraps off of the cable drum.

29 Claims, 14 Drawing Sheets

U.S. PATENT DOCUMENTS

| | | | | |
|---|---|---|---|---|
| 4,640,050 | A | 2/1987 | Yamagishi et al. | 49/280 |
| 4,644,693 | A | 2/1987 | Wang | 49/280 |
| 4,744,449 | A | 5/1988 | Sekella et al. | 192/84 C |
| 4,880,199 | A | 11/1989 | Harney | 248/396 |
| 4,916,861 | A | 4/1990 | Schap | 49/31 |
| 4,932,715 | A | 6/1990 | Kramer | 296/155 |
| 4,945,677 | A | 8/1990 | Kramer | 49/210 |
| 4,952,080 | A | 8/1990 | Boiucaner et al. | 388/811 |
| 4,966,045 | A | 10/1990 | Harney | 74/428.8 A |
| 5,004,280 | A | 4/1991 | Schap | 292/341.16 |
| 5,014,958 | A | 5/1991 | Harney | 248/394 |
| 5,039,925 | A | 8/1991 | Schap | 318/282 |
| 5,046,283 | A | 9/1991 | Compeau et al. | 49/138 |
| 5,056,633 | A | 10/1991 | Noel | 192/35 |
| 5,066,056 | A | 11/1991 | Schap | 292/341.16 |
| 5,076,016 | A | 12/1991 | Adams et al. | 49/360 |
| 5,105,131 | A | 4/1992 | Schap | 318/282 |
| 5,127,190 | A | 7/1992 | Hein et al. | 49/31 |
| 5,138,795 | A | 8/1992 | Compeau et al. | 49/138 |
| 5,168,666 | A | 12/1992 | Koura et al. | 49/360 |
| 5,178,026 | A | 1/1993 | Matsumoto | 74/411 |
| 5,263,762 | A | 11/1993 | Long et al. | 296/146.4 |
| 5,295,038 | A | 3/1994 | Matsushita et al. | 361/152 |
| 5,316,365 | A | 5/1994 | Kuhlman et al. | 296/155 |
| 5,319,880 | A | 6/1994 | Kuhlman | 49/360 |
| 5,319,881 | A | 6/1994 | Kuhlman | 49/360 |
| 5,323,570 | A | 6/1994 | Kuhlman et al. | 49/360 |
| 5,326,473 | A | 7/1994 | Lascombes et al. | 210/474 |
| 5,336,165 | A | 8/1994 | Twardowski | 604/5 |
| 5,347,755 | A | 9/1994 | Jaster et al. | 49/25 |
| 5,350,986 | A | 9/1994 | Long et al. | 318/432 |
| 5,351,439 | A | 10/1994 | Takeda et al. | 49/28 |
| 5,396,158 | A | 3/1995 | Long et al. | 318/282 |
| D358,219 | S | 5/1995 | Ushikubo | D24/224 |
| 5,434,487 | A | 7/1995 | Long et al. | 318/286 |
| 5,477,093 | A | 12/1995 | Lamb | 310/75 D |
| 5,477,094 | A | 12/1995 | Lamb | 310/75 D |
| 5,487,827 | A | 1/1996 | Peterson et al. | 210/87 |
| 5,507,119 | A | 4/1996 | Sumiya et al. | 49/218 |
| 5,547,645 | A | 8/1996 | Ego et al. | 422/264 |
| D374,481 | S | 10/1996 | McCallister et al. | D24/121 |
| D376,424 | S | 12/1996 | Macauley et al. | D24/121 |
| 5,582,279 | A | 12/1996 | Buchanan, Jr. et al. | 192/54.5 |
| 5,591,344 | A | 1/1997 | Kenley et al. | 210/636 |
| 5,658,456 | A | 8/1997 | Kenley et al. | 210/85 |
| 5,668,424 | A | 9/1997 | Lamb | 310/103 |
| 5,691,587 | A | 11/1997 | Lamb | 310/103 |
| 5,692,410 | A | 12/1997 | Fenelon | 74/411 |
| 5,737,876 | A | 4/1998 | Dowling | 49/360 |
| 5,746,025 | A | 5/1998 | Shimura | |
| 5,755,059 | A | 5/1998 | Schap | 49/360 |
| D395,517 | S | 6/1998 | Treu et al. | D24/224 |
| 5,778,843 | A | 7/1998 | Inoue et al. | 123/142.5 R |
| 5,788,099 | A | 8/1998 | Treu et al. | 215/230 |
| 5,806,246 | A * | 9/1998 | Azuma | 49/360 |
| 5,813,282 | A | 9/1998 | Azuma | 74/89.22 |
| D403,079 | S | 12/1998 | Pawlak et al. | D24/224 |
| 5,867,940 | A | 2/1999 | Watanaba et al. | 49/360 |
| 5,875,588 | A | 3/1999 | Torii et al. | 49/349 |
| 5,884,433 | A * | 3/1999 | Watanabe et al. | 49/360 |
| 5,892,340 | A | 4/1999 | Sasajima et al. | 318/293 |
| 5,906,071 | A | 5/1999 | Buchanan, Jr. | 49/360 |
| 5,909,073 | A | 6/1999 | Lamb | 310/78 |
| 5,913,563 | A | 6/1999 | Watanabe et al. | 296/155 |
| 5,943,913 | A | 8/1999 | Fenelon | 74/411 |
| 5,956,998 | A | 9/1999 | Fenelon | 74/89.17 |
| 5,979,114 | A | 11/1999 | Clark et al. | 49/360 |
| 5,982,126 | A | 11/1999 | Hellinga et al. | 318/468 |
| 5,982,131 | A | 11/1999 | Aino | 318/646 |
| 6,003,193 | A | 12/1999 | Rivin et al. | 15/250.3 |
| 6,009,671 | A | 1/2000 | Sasaki et al. | 49/352 |
| 6,027,032 | A | 2/2000 | Aoki et al. | 237/12.3 R |
| 6,032,415 | A | 3/2000 | Tajima | 49/28 |
| 6,038,818 | A | 3/2000 | Haag et al. | 49/360 |
| 6,100,619 | A | 8/2000 | Buscher et al. | 310/99 |
| 6,108,976 | A | 8/2000 | Kato et al. | 49/360 |
| 6,114,820 | A | 9/2000 | Nishigaya | 318/466 |
| 6,125,586 | A | 10/2000 | Buscher | 49/360 |
| 6,134,836 | A | 10/2000 | Kawanobe et al. | 49/360 |
| 6,161,894 | A | 12/2000 | Chapman | 296/155 |
| 6,179,742 | B1 | 1/2001 | Haag et al. | 475/154 |
| 6,183,040 | B1 | 2/2001 | Imaizumi et al. | 296/155 |
| 6,198,242 | B1 | 3/2001 | Yokomori et al. | 318/445 |
| 6,199,322 | B1 | 3/2001 | Itami et al. | 49/139 |
| 6,216,393 | B1 | 4/2001 | Apprich | 49/212 |
| 6,231,113 | B1 | 5/2001 | Armbruster et al. | 296/155 |
| 6,237,737 | B1 | 5/2001 | Jorgensen et al. | 192/84.92 |
| 6,247,373 | B1 | 6/2001 | Bree et al. | 73/862.381 |
| 6,270,148 | B1 | 8/2001 | Noda et al. | 296/155 |
| 6,270,149 | B1 | 8/2001 | Fukumoto et al. | 296/155 |
| 6,390,535 | B1 | 5/2002 | Chapman | 296/155 |
| 6,397,523 | B1 | 6/2002 | Fukumoto et al. | 49/360 |
| 6,405,485 | B1 | 6/2002 | Itami et al. | 49/280 |
| 6,408,573 | B1 | 6/2002 | Fukumoto et al. | 49/360 |
| 6,425,206 | B1 | 7/2002 | Noda et al. | 49/360 |
| 6,430,875 | B1 | 8/2002 | Clark et al. | 49/360 |
| 6,460,295 | B1 | 10/2002 | Johnson et al. | 49/360 |
| 6,464,287 | B2 | 10/2002 | Rogers, Jr. et al. | 296/155 |
| 6,481,783 | B1 | 11/2002 | Rogers, Jr. et al. | 296/155 |
| 6,561,569 | B1 | 5/2003 | Risdon et al. | 296/155 |
| 6,575,864 | B1 | 6/2003 | Dean | 475/5 |
| 6,588,829 | B2 | 7/2003 | Long et al. | 296/155 |
| 6,866,250 | B2 * | 3/2005 | Kita | 254/225 |
| 2001/0022049 | A1 | 9/2001 | Clark et al. | 49/360 |
| 2003/0046872 | A1 | 3/2003 | Fukumura et al. | 49/360 |

FOREIGN PATENT DOCUMENTS

| | | | |
|---|---|---|---|
| DE | 4041480 | A1 | 6/1992 |
| DE | 4132293 | C2 | 5/1994 |
| DE | 4113391 | C2 | 2/1995 |
| DE | 19712185 | C1 | 3/1998 |
| DE | 19714214 | A1 | 10/1998 |
| DE | 19814670 | | 10/1998 |
| DE | 19724009 | A1 | 12/1998 |
| EP | 0421776 | A2 | 4/1991 |
| EP | 0626498 | B1 | 1/1997 |
| EP | 0625625 | B1 | 3/1997 |
| EP | 0625815 | B1 | 3/1997 |
| EP | 0609585 | B1 | 4/1997 |
| EP | 0611869 | B1 | 5/1997 |
| EP | 0980776 | A2 | 2/2000 |
| FR | 2603647 | A1 | 3/1988 |
| GB | 2097855 | A | 11/1982 |
| GB | 2323124 | A | 9/1998 |
| JP | 52-55117 | | 5/1977 |
| JP | 55-30060 | | 3/1980 |
| JP | 57-111972 | | 7/1982 |
| JP | 57-117171 | | 7/1982 |
| JP | 58-28115 | | 2/1983 |
| JP | 58-30827 | A | 2/1983 |
| JP | 61-36481 | | 2/1986 |
| JP | 07067293 | A | 3/1995 |
| JP | 9-48244 | | 2/1997 |
| JP | 10-266697 | | 10/1998 |
| JP | 2000-160933 | | 6/2000 |
| WO | WO02/072374 | A1 | 9/2002 |

* cited by examiner

APPARATUS AND METHOD FOR PROVIDING A MODULAR SLIDING DOOR MECHANISM

CROSS REFERENCE TO RELATED APPLICATIONS

This application claims the benefit of U.S. Provisional application Ser. No. 60/455,989, filed Mar. 19, 2003, the contents of which are incorporated herein by reference thereto.

This application is also related to co-pending U.S. patent application Ser. No. 10/798,792, filed contemporaneously with the present application, the contents of which are incorporated herein by reference thereto.

TECHNICAL FIELD

The present application relates to vehicle doors and more particularly the present application relates to an apparatus and method for providing a modular sliding door mechanism.

BACKGROUND

A typical vehicle is manufactured with a plurality of openable doors. Each door is typically mounted on hinges within a door opening. Some larger vehicles have sliding doors that slide from an open position to closed position thus, egress and ingress of the vehicle is possible without requiring a large open area beside the vehicle to allow for pivoting of the door. This is particularly useful in parking lots where the area between the vehicles is typically not large enough to allow for full pivoting of the opening doors. Moreover, such sliding doors also allow the vehicles to have larger door openings.

Accordingly, sliding doors provide access to large door openings without requiring a large area adjacent to the vehicle which would be required for a door that pivots on its hinge. In one configuration, a power sliding door is supported and guided by an upper track, a center track and a lower track. An upper roller is attached to the power sliding door and travels in the upper track. A lower roller is attached to a lower portion of the sliding door and runs or travels in the lower track. A hinge and roller assembly is pivotally attached to a rear portion (e.g., towards the rear of the vehicle) of the door between the upper and lower portions of the door. The hinge and roller assembly is also received in the track to allow for sliding or movement of the door.

In addition to the usage of sliding doors in vehicles, power drive systems have been implemented wherein automatic opening, closing, locking and unlocking of the sliding door is facilitated through a drive system coupled to the sliding door. Presently, some sliding doors are driven through cables attached to the forward and aft sides of the center roller hinge (e.g., a hinge mounted towards the center of the door with respect to the upper and lower edges of the same). During installation on the vehicle, the cables are separately routed into the interior of the vehicle housing (e.g., between the inner and outer surfaces of the vehicle body) through holes in the sheet metal and are wrapped around pulleys of the power sliding door drive unit within the vehicle. These systems are complex, non-modular, cumbersome to install, and require the cables to be routed through the vehicle, the system, tensioned and then secured to the hinge during assembly of the system on the vehicle (e.g., on the assembly line).

The drive unit output force necessary to seal the door with the front cable attached to the center roller hinge is larger than the door seal force (e.g., the necessary seal force applied normal to the surface of the door or inwardly towards the vehicle from the exterior of the door). The aforementioned seal force refers to the force necessary to close the door when it is positioned over or about the door opening into which the door is received. The previously mentioned difference in required seal force is typically due to the inefficiency of transferring the force from the cable to the door via the center roller hinge/roller track/door interface.

In addition, non-modular power drive systems include many components that must be installed together on the assembly line. Accordingly, many power sliding doors and their associated non-modular drive systems require significant work to install on the assembly line as multiple separate components must be installed and tested during the vehicle assembly process. Moreover, these systems impact on the available real estate within the vehicle. These systems also use valuable package space such as in the door and in the rear quarter of the vehicle.

Accordingly, it is desirable to provide a power drive system for a vehicle sliding door that is efficient in transferring force to the sliding door and is easy to install. Moreover, it is desirable to provide a system that does not take up a large amount of space within the vehicle.

SUMMARY OF THE INVENTION

A modular drive assembly for a sliding door, comprising: a guide track having a hinge assembly slidably received therein; a pair of pulleys disposed on either end of said guide track, said pair of guide pulleys being disposed adjacent to a path of travel of said hinge assembly within said guide track, said path of travel being defined by a closed door limit and an open door limit; a pair of cables each having an end that is secured to said hinge assembly and the other end is secured to a cable drum of a motor drive unit mounted to said guide track, said motor drive unit being configured to rotate said cable drum, wherein said cable drum is also capable of freely rotating within said motor drive unit when said motor drive unit is not rotating said cable drum, wherein rotation of said cable drum causes said hinge assembly to move in said guide track as one of said cables wraps onto said cable drum while the other one of said cables wraps off of said cable drum, wherein said hinge assembly passes a portion of one of said pair of pulleys when said hinge assembly is at said closed door limit and said hinge assembly passes a portion of the other one of said pair of pulleys when said hinge assembly is at said open door limit.

A drive assembly for a sliding door of a vehicle, comprising: a guide track having a hinge assembly slidably received therein, said guide track being configured to provide a center track for the sliding door; a front pulley disposed on a forward end of said guide track, said front pulley being configured such that said front pulley does not protrude in a door opening of the vehicle any more than a portion of said guide track said front pulley is rotatably mounted to; a pair of cables each having an end that is secured to said hinge assembly and the other end is secured to a single cable drum of the drive assembly, said single cable drum being located a the rear end of said guide track; and a guide pulley disposed proximate to said cable drum, wherein rotation of said cable drum causes said hinge assembly to move in a path of travel defined by said guide track as one of said cables wraps onto said cable drum while the other one of said cables wraps off of said cable drum, wherein said pulley changes the direction of one of said pair of cables as they wrap off of said cable drum, said path of travel being defined by an open door limit and a closed door limit.

A method for installing a drive assembly to a vehicle, the drive assembly providing an opening and a closing force to move a sliding door of the vehicle, the method comprising: providing a modular drive assembly comprising a lower guide track, said modular drive assembly providing the opening and the closing force for moving the sliding door, wherein said modular drive assembly comprises all of the necessary components for providing the opening and the closing force to the sliding door prior to the modular drive assembly being installed in the vehicle; and installing said modular drive assembly into a mounting cavity of the vehicle by first sliding the modular drive assembly into the mounting cavity and then upwardly moving the modular drive assembly such that a plurality of mounting studs of the modular drive assembly are received within complimentary openings in a structural panel of the vehicle.

DETAILED DESCRIPTION OF EXEMPLARY EMBODIMENTS

Exemplary embodiments of the present invention relate to an apparatus and method for providing a modular drive unit that is easy to install and provides the necessary components for opening and closing the power sliding door wherein efficient transference of the seal force is achieved.

Prior apparatus and methods for providing and/or effectuating moving of a sliding door of a vehicle are found in U.S. Pat. Nos. 5,046,283; 5,313,795; 5,319,880; 5,319,881 and 5,323,570 the contents of which are incorporated herein by reference thereto.

A modular system of an exemplary embodiment provides a means for efficient seal force transfer while simplifying the installation process thus, decreasing the associated manufacturing costs. In one embodiment, the proposed drive unit will drive off of the lower roller hinge and will be located on the lower sliding door track. The system will be modular so that all the components needed for the power sliding door drive unit will be attached to the lower track. This allows for an easy slide in assembly sequence for the vehicle assembly line. The system will also keep valuable space in the door and rear quarter available for other items in a vehicle. Thus, the modular unit is installed in a single step and the only remaining steps are the securement of the door to the hinge and the connection of a power supply to the drive unit.

Figure 1:
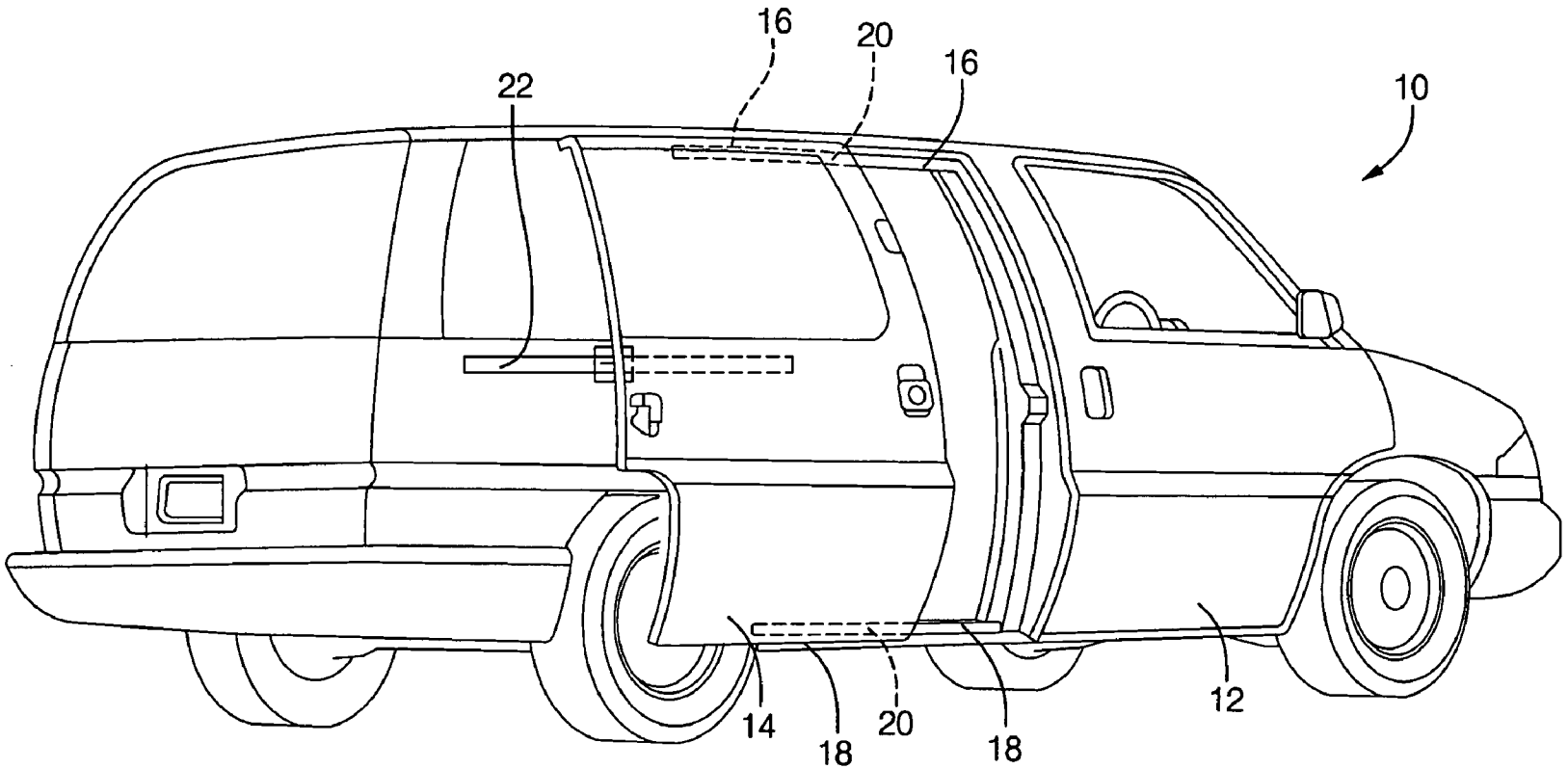
FIG. 1 is a right hand perspective side view of a vehicle having a sliding door installed therein.

Referring now to FIG. 1, a vehicle 10 with a front pivoting door 12 and a power sliding door 14 is illustrated. Here power sliding door 14 is guided by rollers that are slidably received in an upper track 16 and a lower track 18. The rollers 20 are configured to be received in upper track 16 and lower track 18. In addition to upper track 16 and lower track 18, and in accordance with an exemplary embodiment, a center track 22 is also provided. Center track 22 is also configured to receive and engage a roller 20 that is coupled to sliding door 14.

Figure 2:
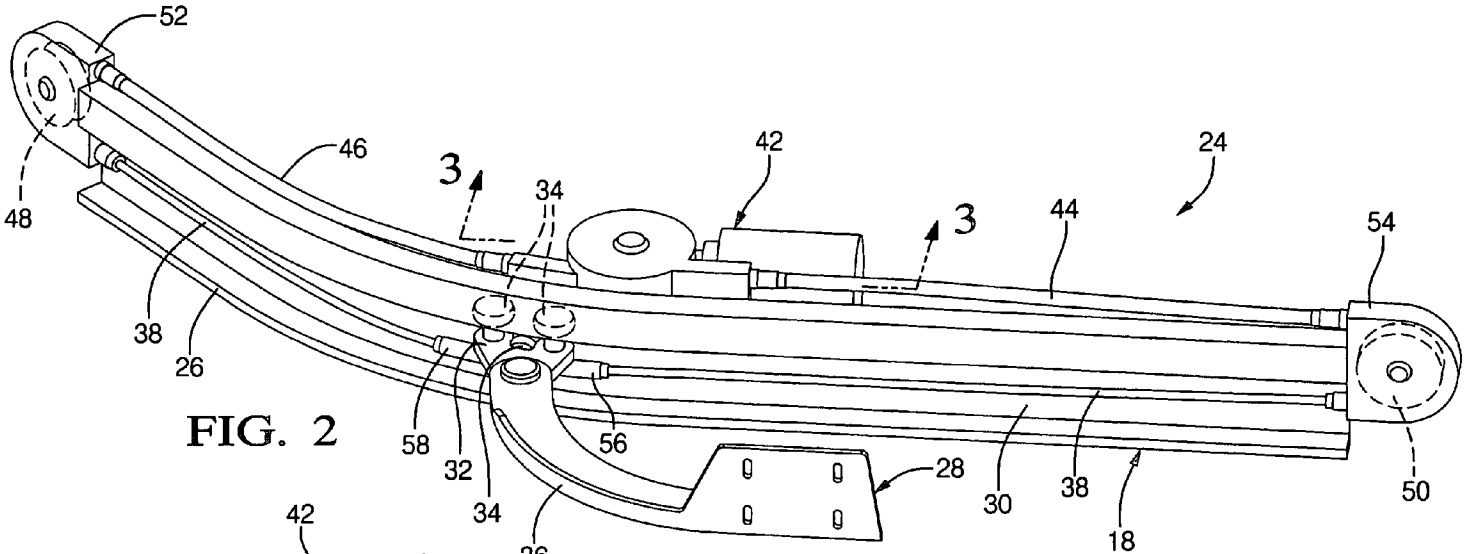
FIG. 2 is a perspective view of a modular power sliding door drive assembly constructed in accordance with an exemplary embodiment of the present invention.
Figure 3:
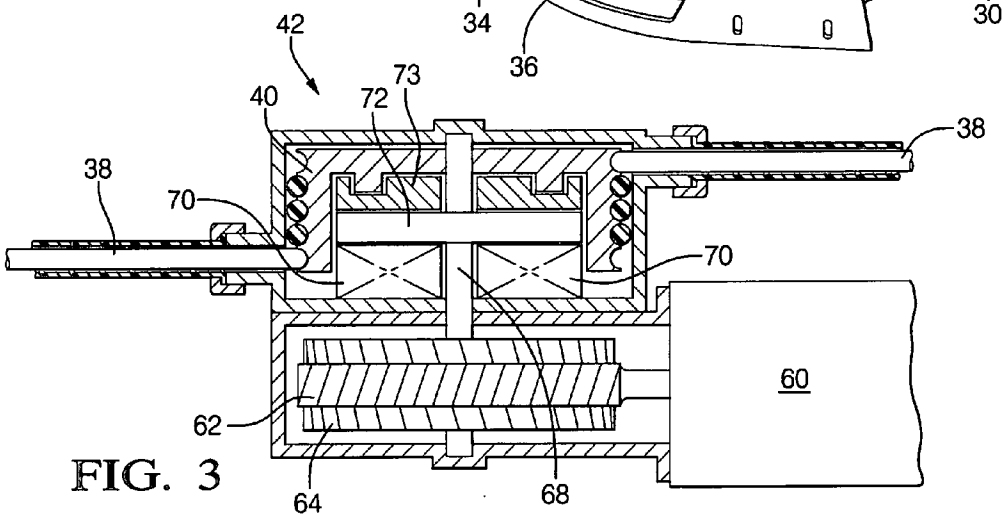
FIG. 3 is a view along lines 3-3 of FIG. 2.

Referring now to FIGS. 2 and 3, the modular power sliding door system of an exemplary embodiment is illustrated. As illustrated, an exemplary embodiment comprises a modular system 24 wherein all the drive components are attached to a lower sliding door track and the system is easily installed as a single unit. In accordance with an exemplary embodiment modular system 24 comprises a door track 26 for defining a path of travel for the sliding door. The path of travel defines an open position of the door and a closed position of the door. In accordance with an exemplary embodiment system 24 is a cable drive system wherein cables are manipulated to drive a hinge 28 which is secured to the sliding door.

Door track 26 defines a channel 30 for slidably receiving a portion 32 or lower roller hinge 28. Door track 26 can be manufactured out of a steel stamping of any equivalent thereof wherein the curvature of the track is easily defined as well as the configuration of the channel. The door track is configured to be installed as a complete unit into the vehicle, which in accordance with one exemplary embodiment will be installed within a cavity of a lower portion of a vehicle defined by a vehicle rocker panel.

One method or means for allowing portion 32 to be slidably received within channel 30 is to provide rollers 34, which will allow hinge 28 to slide therein. Also, portion 32 is pivotally secured to a mounting portion 36 of hinge 28. The pivotal securement of portions 32 and 36 will allow for the proper movement of the sliding door as it moves along the contour of track 26, which is configured to match the contour of the vehicle. It is, of course, understood that the hinge 28 may comprise a single unit with the pivotal movement being facilitated by the securement of one end to the door and the other end to the track.

In an exemplary embodiment, a pair of cables 38 are secured to hinge 28. One cable 38 is secured to a forward side of the hinge and the other is secured to the rearward side of the hinge and the other ends of the cables are each secured to a single drum 40 of a motor drive unit 42. The cables are attached to either side of the drum such that while one cable raps off the drum the other will rap on. Alternatively, drum 40 may comprise two drums that are secured to each other by a spring biasing means in order to provide tension to cables 38 as the hinge assembly travels within the guide track. In yet another alternative embodiment, drum 40 is configured to have drums of varying dimensions or diameters were in a smaller diameter portion is used to provide a greater torque to the cable. The smaller diameter is contemplated for used during the closing or latching portion of door travel wherein higher forces are preferred.

The cables also pass through conduits 44 and 46. Conduits 44 and 46 extend out from the housing of motor drive unit 42 in opposite directions. Conduits 44 and 46 provide a means for protecting the cables from being damaged or interfered with as they wrap onto and off of cable drum 40. Disposed at either end of the track is a pair of cable pulleys 48 and 50. Pulleys 48 and 50 are rotatably mounted to the ends of track 26. Pulleys 48 and 50 allow the cable to transition from the conduit into the channels of track 26 and ultimately to the tensioners or alternatively the cables are directly secured to a portion of hinge 28. In yet another alternative and in lieu of spring tensioners 56 and 58 either or both pulleys 48 and 50 can be secured to the guide track by a member movably connected to the guide track wherein a biasing member applies a biasing force to the pulley or the member the pulley is mounted to as the hinge assembly transitions through the guide track. The cables extend out to either side of the lower roller hinge where they are attached to the same through spring tensioners 56 and 58. An intended purpose of tensioners 56 and 58 is to allow for the carrying length of cable needed throughout the sliding door's travel, especially through the bend in the track (e.g., the bend portion of the track necessary to transition the sliding door into its fully closed position). The purpose of the tensioners is to allow for a varying length of cable needed throughout the sliding door's travel, especially through the bend in the track where increased forces may be required to pull the door into a locked position. Pulleys 48 and 50 are disposed within pulley housings 52 and 54, respectively. Housings 52 and 54 enclose and protect the pulleys and the cable from debris and contaminates that may affect performance of the same (e.g., increase resistance or cause undesirable noise or vibrations).

Accordingly, the cable pulleys provide a means for guiding and completing the cable loop which causes the desired movement of the hinge. As discussed above, the movement of the hinge is facilitated by winding one of the cables onto the cable drum while allowing the other cable to unwind therefrom thus, allowing the hinge to slide within the track.

Motor drive unit 42 provides the necessary driving force for the modular system 24. More particularly, motor drive unit 42 provides the force for rotating cable drum 40 in order to effect the desired movement of hinge 28 and ultimately sliding door 14. In accordance with an exemplary embodiment motor drive unit 42 is configured to have a height profile not greater than the height profile of the modular drive unit or track 26. Thus, the exemplary embodiment disclosed herein requires no additional vehicle space as would be required for only track 26 and the hinge disposed therein. Moreover, modular drive unit 24 is easily installed in its operative location, as the height of the system is the same as a receiving cavity planned for use of track 26. This is accomplished by providing a compact motor drive unit that is capable of generating the required torque or force to rotate cable drum 40. However, it is also contemplated in applications where there is additional room for installation of the modular unit, the motor drive unit housing may be slightly larger than the guide track.

It is noted that the unit illustrated in FIG. 2 is configured for use with a left hand or driver's side vehicle door opening and it is, of course, understood that the configuration of unit 24 may be modified for use in a left hand side opening illustrated in FIG. 1.

As illustrated in FIG. 3, a portion of component parts of a contemplated motor drive unit is illustrated. It is of course understood that the configuration illustrated in FIG. 3 is one example of a contemplated drive unit and the present invention is not intended to be limited by the same as other configurations may be possible as long as the required height restrictions are achieved while also providing the necessary driving force. As illustrated in FIG. 3 motor drive unit comprises a motor 60 for driving a shaft having a worm gear 62. Worm gear 62 is configured to threadingly engage a gear 64. Gear 64 is secured to one end of a shaft 68 rotatably received within an internal cavity defined by the housing of the motor drive unit.

The motor drive unit further comprises an electromagnetic clutch comprising a stationary coil 70 for generating an electromagnetic field in order to couple or uncouple a first frictional surface or rotor 72 to another frictional surface or armature or other equivalent item 73 wherein rotation of shaft 68 by motor 60 will determine whether output gear 40 will be driven by motor 60. In this embodiment friction plate 73 is configured to rotate with cable drum 40 or in other words rotation of friction plate 73 causes rotation of cable drum 40. Accordingly, motor 60 will drive or rotate first frictional surface or rotor 72 and the cable drum will not be rotated until the coil is energized and the two frictional surfaces will engage each other thereby causing rotation of cable drum 40 and ultimately movement of hinge 28. The attraction of the two frictional surfaces is caused by the electromagnetic field or magnetic flux generated by coil 70 as is known in the related arts.

Thus, when the electromagnetic clutch is engaged the door can be powered open or closed. When the clutch is released or the electromagnetic clutch is not engaged the door can be moved freely because the cable drum is allowed to move freely as there will be no frictional engagement between the two friction plates. It is of course understood that other clutch devices may be employed with the present invention as long as the require performance criteria are met.

In order to operate the power sliding door of vehicle 10 it is contemplated that a sensing system will be installed in vehicle 10 such that signals received will cause motor drive unit 42 to open or close the door. The sensing system will provide the necessary signals to a control module or microprocessor having an algorithm for executing commands pursuant to signals received from the sensors. An example of a sensor and controller arrangement could have found in U.S. Pat. Nos. 5,263,762; 5,350,986; 5,396,158; 5,434,487; and 6,247,373 the contents of which are incorporated herein by reference thereto. It is of course understood that the aforementioned U.S. patents merely provide examples of sensor and controller arrangements capable of being used with the present invention.

In accordance with an alternative exemplary embodiment guide track 26 is configured to define a cavity or a portion of a cavity for receipt of the housing of the motor drive unit thus, and in this embodiment the modular drive unit will have an exterior profile or external dimensions that are no larger than those required for a guide track without a motor unit disposed therein or thereon.

With all of the aforementioned components attached to the lower roller hinge it is easy for an operator on the vehicle assembly line to take the entire unit and slide it into the lower track areas and attach it with fasteners, which pass through predetermined mounting openings located on the guide track. Accordingly, the modular drive unit allows the same to be installed in the vehicle with significantly less steps than many other current power sliding doors, as no other mechanical components are required. Thus, assembly 24 is located in its proper position and is secured by passing bolts or other securement means through pre-arranged drill holes.

In addition, and since the modular unit is self contained operation of the drive unit and movement of the hinge within track 26 can be manufactured tested and assembled at a location remote to where the unit is installed in the vehicle. Therefore, efficient practices for manufacturing modular system 24 are capable of being performed (e.g., drive unit testing) prior to the shipment and installation of the same in the vehicle. Moreover, the single unit is installed in the vehicle and in the case of the lower guide track the only remaining assembly step is the securement of the door to the hinge assembly. In the case of the center guide track, the modular unit with all of the components pre-assembled, except for the motor drive unit, is installed on the exterior of the vehicle and then the only exterior assembly step is the securement of the door to the hinge assembly while the motor drive unit is installed from within the interior of the vehicle such that a drive member of the motor drive unit is received within a drive opening of a cable drum secured to the center guide track.

Figure 4:
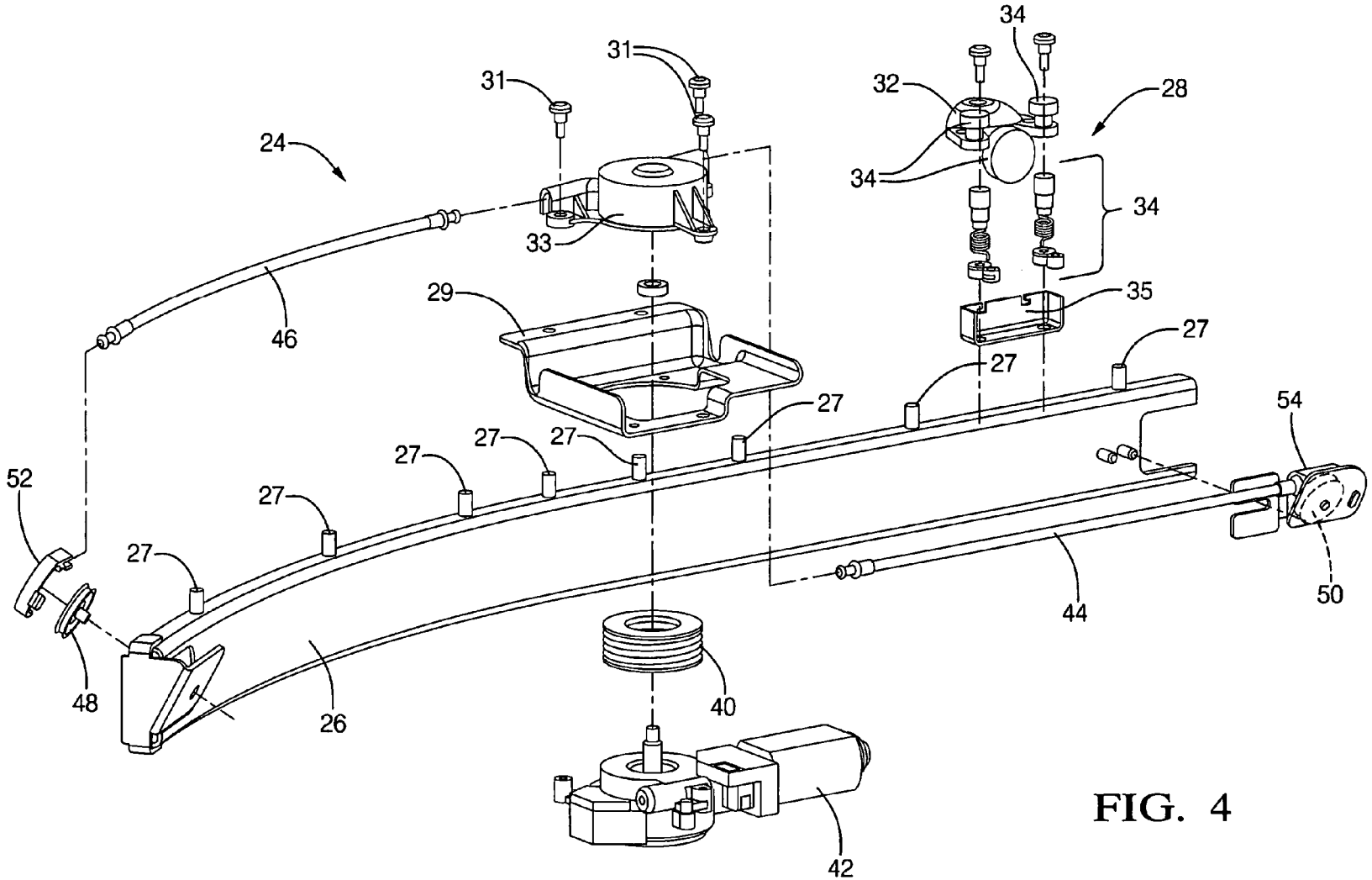
FIG. 4 is an exploded view of a modular power sliding door assembly in accordance with an exemplary embodiment of the present invention.
Figure 7A:
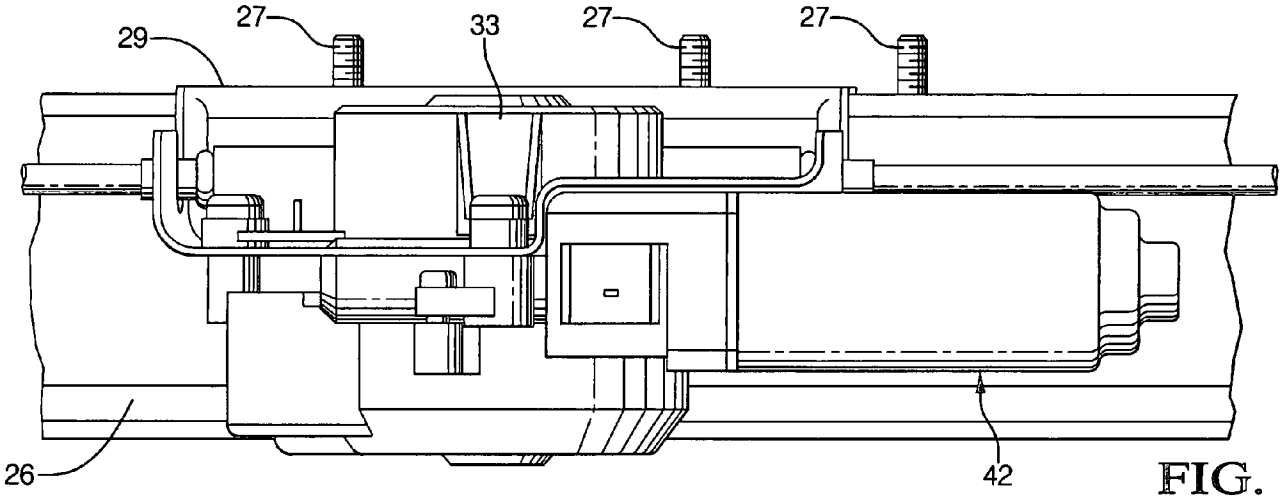
FIG. 7A is a side elevation of view of the motor drive unit of the modular power sliding door assembly illustrated in FIG. 5.
Figure 7B:
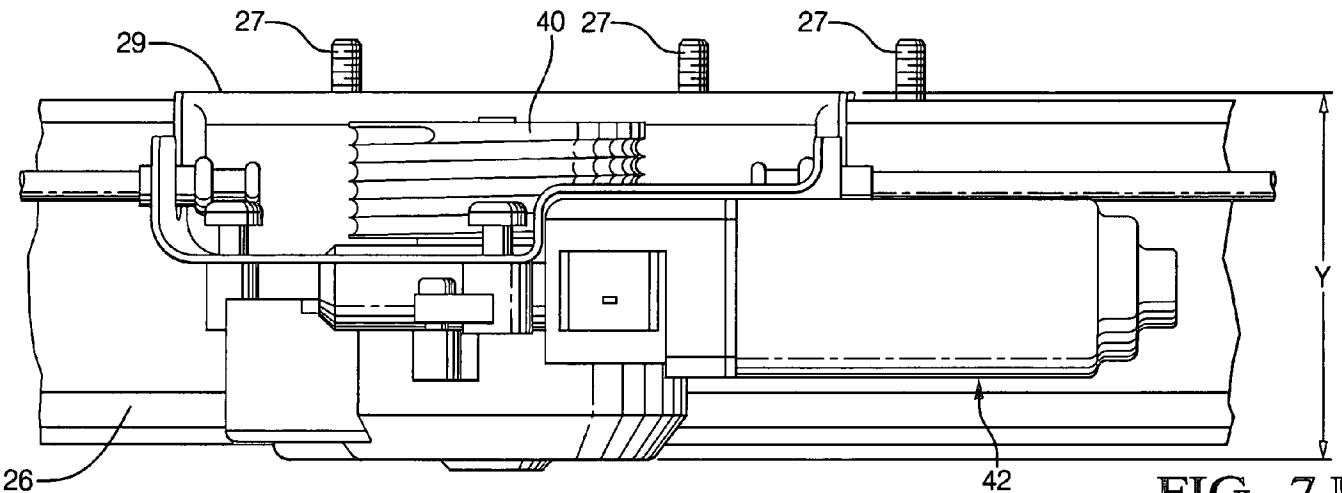
FIG. 7B is a side elevation of view illustrating internal components of the motor drive unit of the modular power sliding door assembly illustrated in FIG. 5.
Figure 8:
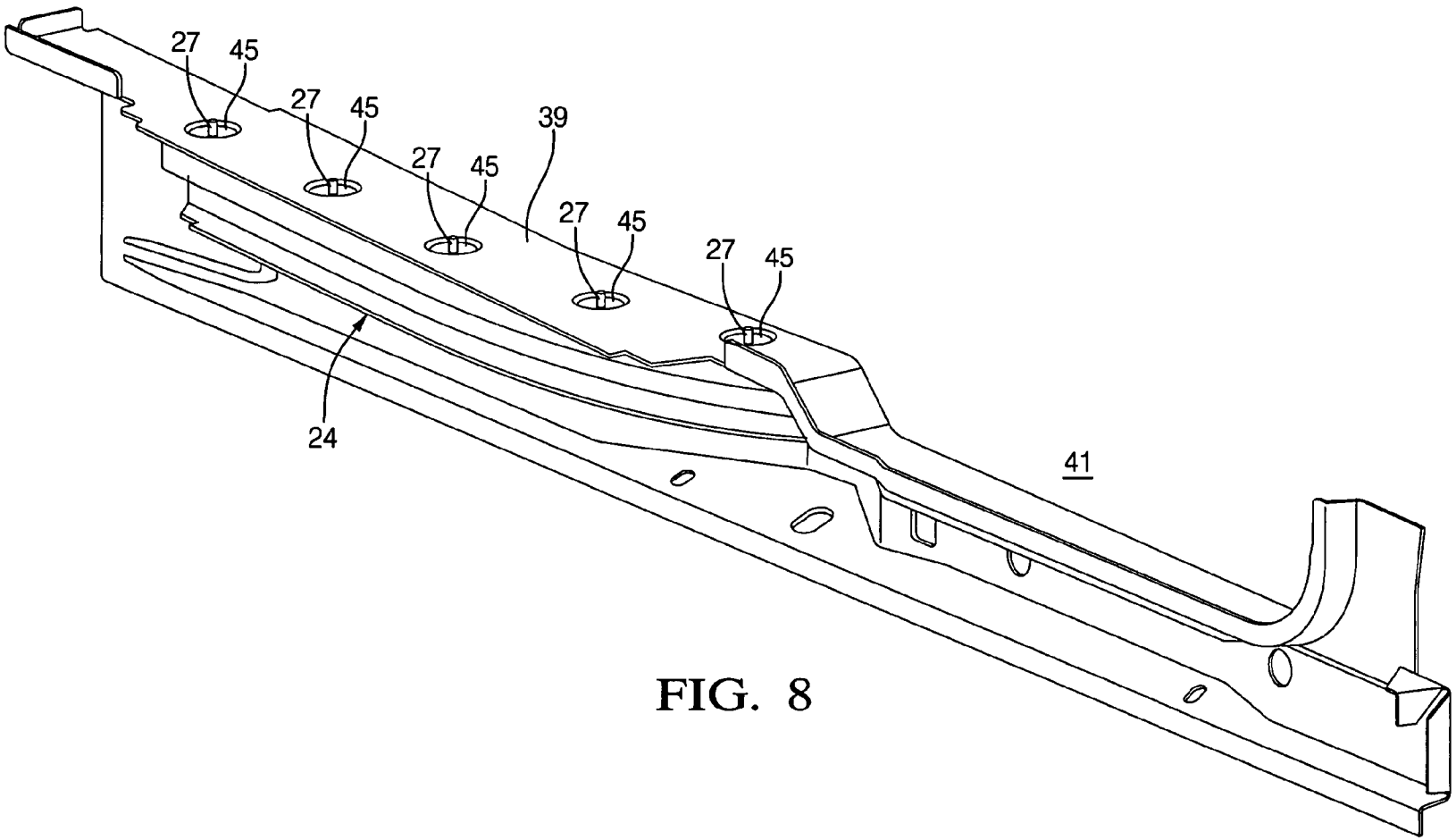
FIG. 8 is an outboard perspective view of a modular power sliding door assembly inserted into a rocker panel of a vehicle in accordance with an exemplary embodiment of the present invention.
Figure 9:
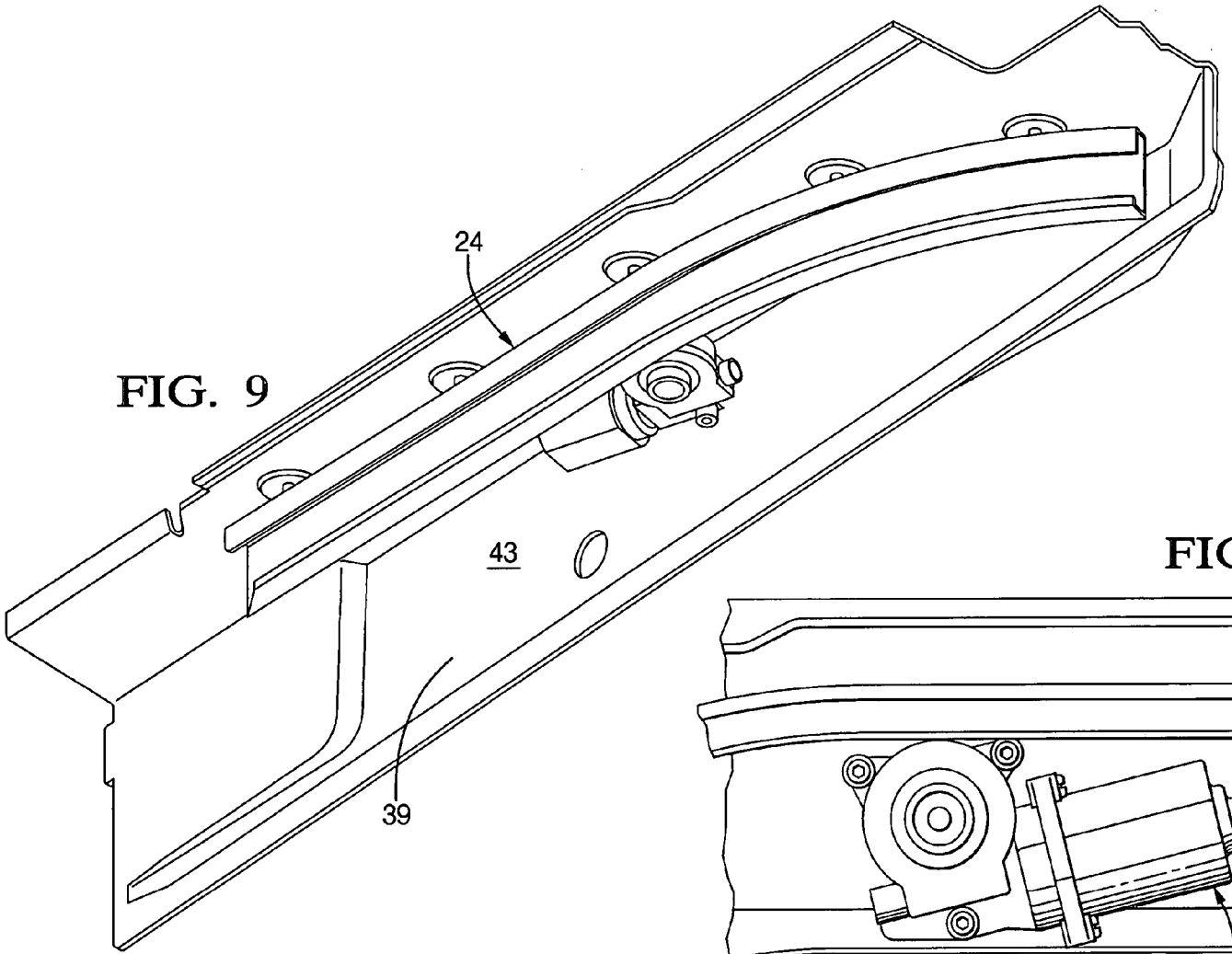
FIG. 9 is a lower perspective view of a modular power sliding door assembly inserted into a rocker panel of a vehicle in accordance with an exemplary embodiment of the present invention.

An example of an exemplary embodiment for installation as a modular unit as a lower guide track within a vehicle body is now illustrated with reference to FIGS. 4-10B. As illustrated in FIG. 4, modular system 24 is presented in an exploded view. As illustrated, guide track 26 comprises a plurality of mounting studs 27 which are disposed along an upper or mounting surface of guide track 26. Mounting studs 27 are configured to be received within a plurality of mounting openings within a rocker panel of a vehicle (FIGS. 8-9). Also illustrated in FIG. 4 is a mounting flange 29. Mounting flange 29 provides a mounting means for securing motor drive unit 42 to guide track 26. Mounting flange 29 has a plurality of openings for receiving studs 27 as well as openings for receiving a plurality of mounting bolts 31 for mounting an upper housing 33 of motor drive unit 42 to mounting flange 29. Thus, motor drive unit 42 is secured to mounting flange 29 and mounting flange 29 is secured to guide track 26. Of course, other mounting arrangements for securing motor drive unit 42 to guide track 26 are contemplated to be within the scope of the present invention and the aforementioned example is provided as a non-limiting example. Also illustrated in FIG. 4 is a portion of hinge assembly 28 wherein portion 32 comprises a lower portion 35 mounted thereto, lower portion 35 is mounted to portion 32 by a tensioning arrangement 37, which comprises tensioners, springs and mounting elements. Also illustrated in FIG. 4 is that housings 52 and 54 for pulleys 48 and 50 further comprise mounting flanges for securement to guide track 26.

Figure 5:
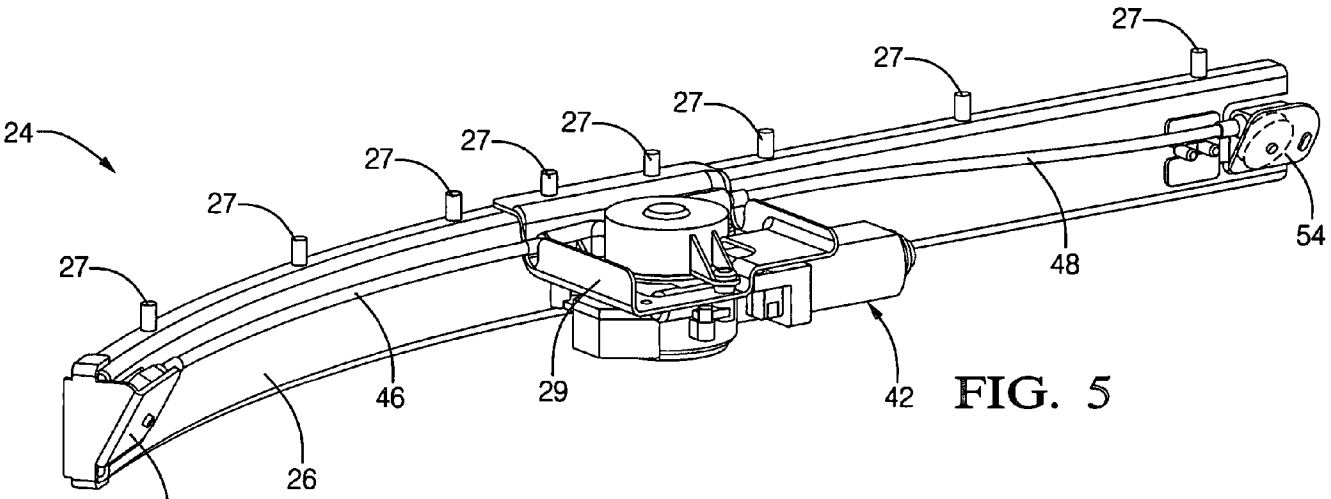
FIG. 5 is an inboard perspective view of a modular power sliding door assembly in accordance with an exemplary embodiment of the present invention.
Figure 6:
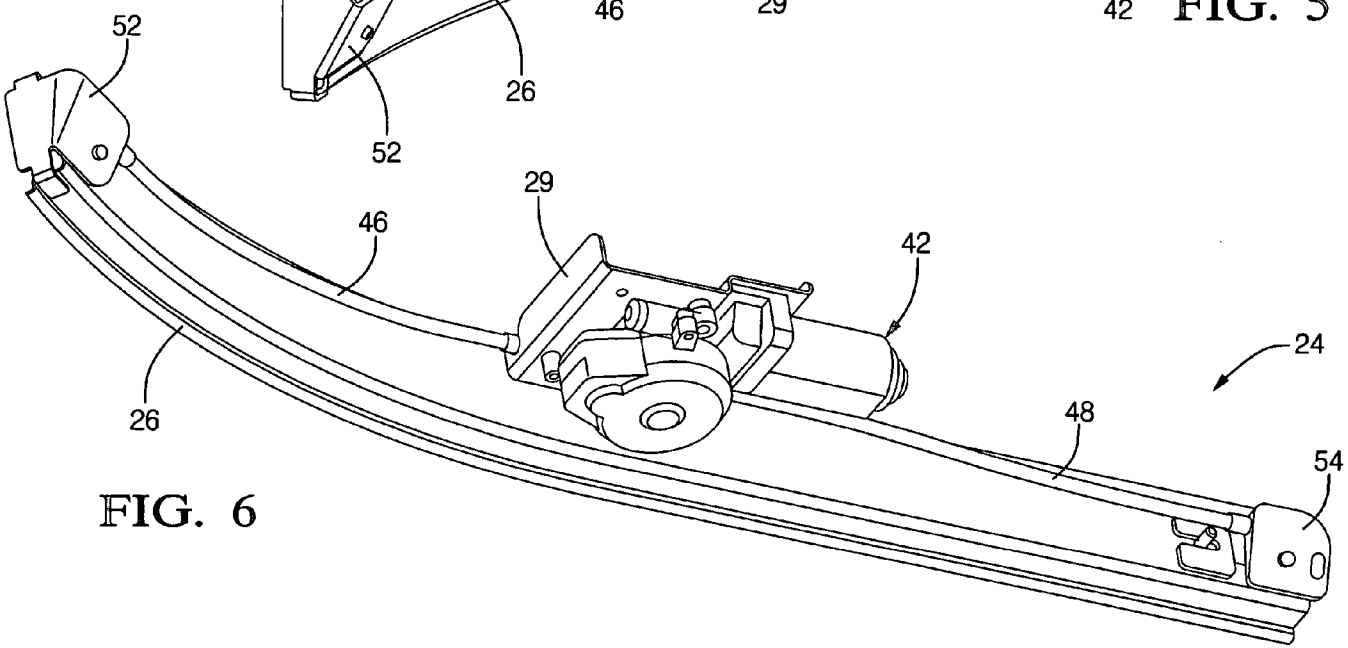
FIG. 6 is a lower perspective view of the modular power sliding door assembly illustrated in FIG. 5.

FIGS. 5 and 6 illustrated modular system 24 in an assembled state. Referring now to FIGS. 7A-7B, an enlarged view of motor drive unit 42 is illustrated. FIG. 7A illustrates the motor drive unit with housing 33 secured thereto and FIG. 7B illustrates motor drive unit 42 without housing 33 thereby illustrating the location of cable drum 40. FIG. 7B illustrates a dimension "Y" that corresponds to the height of guide track 26, which in a non-limiting example is 68.3 mm, of course, dimensions greater or less than 68.3 mm are contemplated to be within the scope of the present invention.

It is noted that FIGS. 4-6 illustrate a system configured for use with a right hand door opening (e.g., with respect to a forward facing driver or passenger). It is, of course, understood that the system can be configured for use with a left hand door opening.

Referring now to FIGS. 8 and 9, installation of system 24 within an area defined by a portion of a vehicle rocker panel 39 and door opening 41 (partially illustrated in FIG. 8) is illustrated. As illustrated in FIG. 9, the available real estate within an area 43, defined by rocker panel 39, is extremely limited. Accordingly, the unique modular configuration of system 24 allows the complete system (e.g., cables, motor drive unit, guide track, pulleys, hinge assembly, etc.) to be pre-assembled and then it is first slid into or inserted into the opening defined by rocker panel 39 until studs 27 are aligned with complementary openings 45 in a mating surface of rocker panel 39. Then studs 27 are inserted into openings 45 by an upward movement or alternatively a downward or sideways movement depending on the configuration of rocker panel 39. Once the studs are properly positioned within openings 45, securement is facilitated through the securement of a nut or other equivalent device to studs 27. The securement item (e.g., nut) provides a means for securing studs 27 to rocker panel 39. It is contemplated that other securement means may be used to quickly secure system 24 in its preferred location (e.g., welding of studs 27 within openings 45 of rocker panel 39). Therefore, once system 24 is installed to rocker panel 39 hinge assembly 28 will protrude outwardly for ease of securement to the door of the power sliding door system. Accordingly, an exemplary embodiment of the present invention is directed to the apparatus and method of modular installation just described.

Figure 10A:
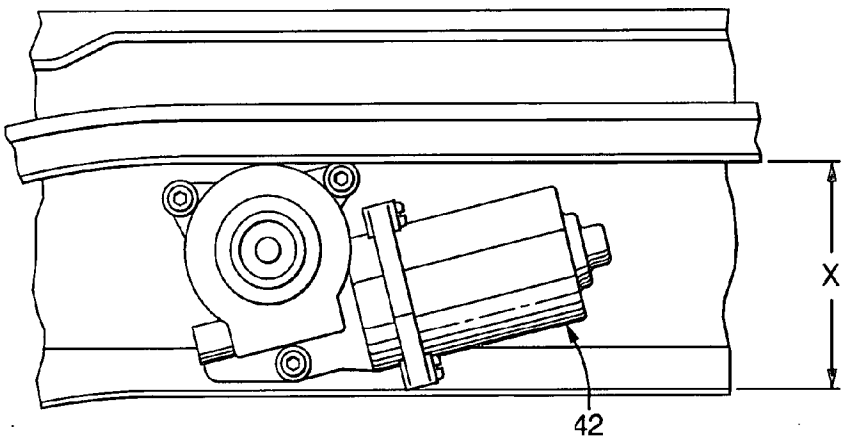
FIG. 10A is a view illustrating an alternative exemplary embodiment of the present invention.
Figure 10B:
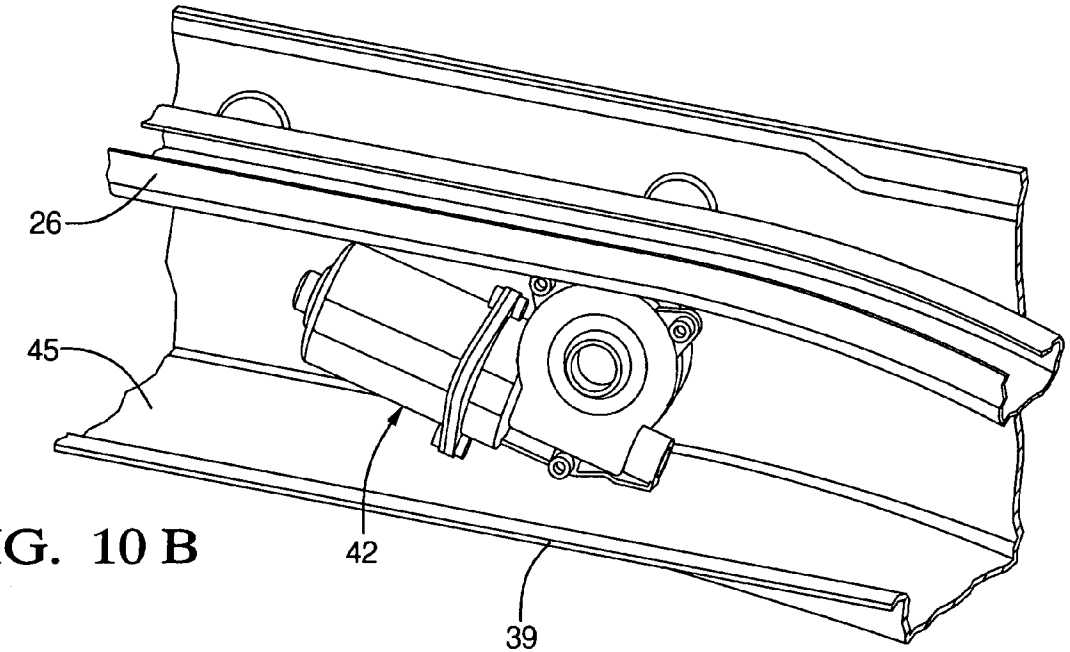
FIG. 10B is a view illustrating another view of the alternative exemplary embodiment illustrated in FIG. 10A.

FIG. 10A illustrates motor drive unit 42 being positioned to have its body angularly configured such that the exterior dimensions of the housing or housings of the motor drive unit are capable of being received within an area defined by a dimension "X" illustrated in FIG. 10A. Dimension "X" being defined by the distance between a surface of guide track 26 and a surface 45 of rocker panel 39. Accordingly, and as applications require modular system 24 will have a motor drive unit configuration that allows the same to be inserted within an area defined between a portion of rocker panel 39 and guide track 26. In one non-limiting example dimension "X" is approximately 91.3 mm of course, other dimensions greater or less than 91.3 mm are considered to be within the scope of the present invention.

Figure 11:
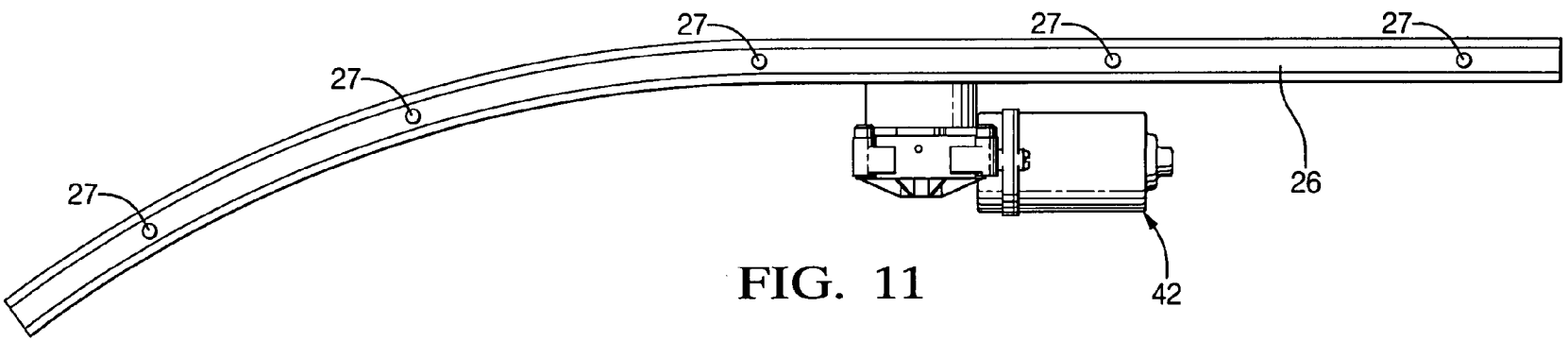
FIG. 11 is a top plan view illustrating another alternative exemplary embodiment of the present invention.
Figure 12A:
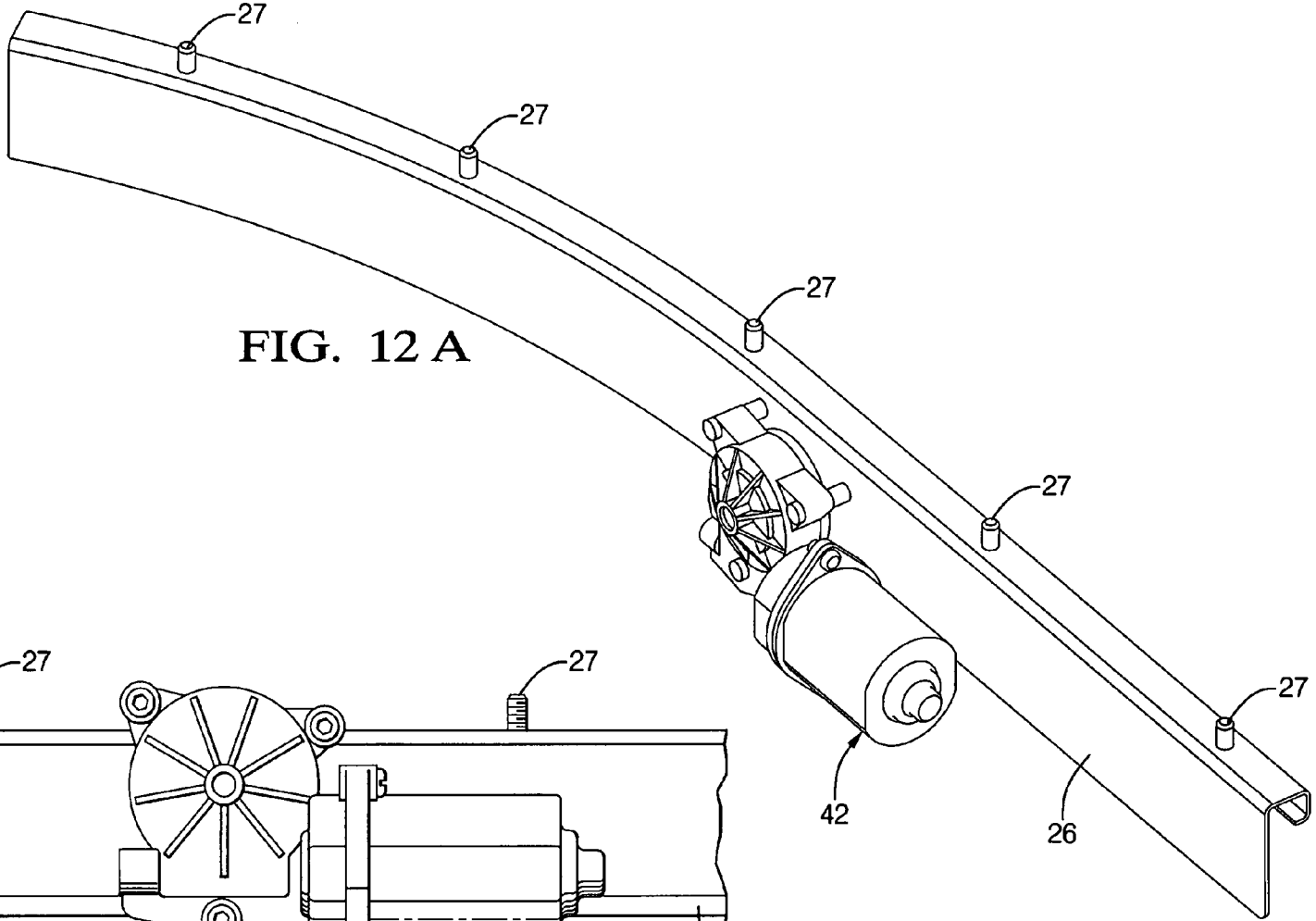
FIG. 12A is a perspective view of the FIG. 11 embodiment.
Figure 12B:
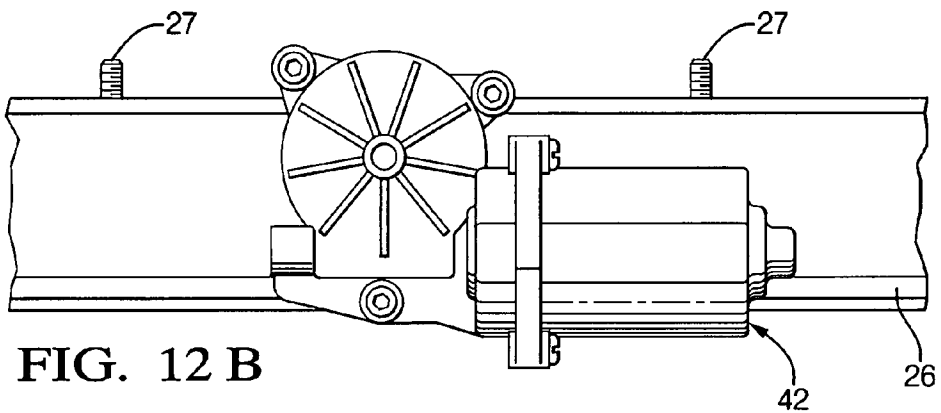
FIG. 12B is an enlarged view of a portion of the FIG. 11 embodiment.

Referring now to FIGS. 11-12B an alternative exemplary embodiment of the present invention is illustrated. Here motor drive unit 42 is mounted such that the axis of rotation of cable drum 40 (not shown) is horizontally positioned with respect to guide track 26 as opposed to a vertical positioning of an axis of rotation, which is shown in FIGS. 4-10B. Accordingly, and in this embodiment, the profile constraints of motor drive unit 42 are driven by the height of guide track 26 as well as the area defined by rocker panel 39 and guide track 26. As referring to herein horizontally and vertically positioning of the axis of rotation with respect to guide track 26 is meant to describe planes of rotation of cable drum 40 with respect to planes of guide track 26 in order to illustrate alternative configurations of motor drive unit 42 with respect to guide track 26.

Figure 13:
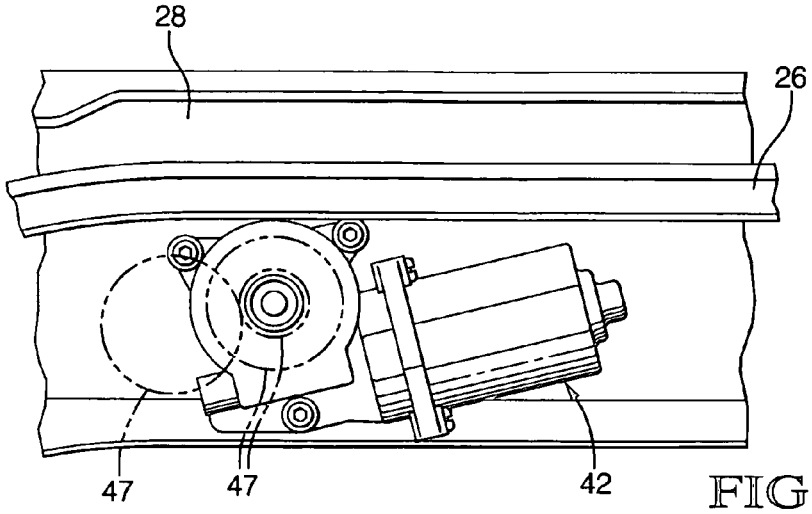
FIG. 13 is a view illustrating another alternative exemplary embodiment of the present invention.

Referring now to FIG. 13 an alternative configuration of motor drive unit 42 is illustrated. Here a plurality of gears 47 of a gear train are rotatably received within a housing of motor drive unit 42. By using a plurality of gears, the axis of rotation of either the worm gear 62 or worm wheel 64 (FIG. 3) are capable of being relocated such that the overall dimensions of motor drive unit 42 may be received within the restricted sized openings defined by rocker panel 39 and guide track 26. Such restrictions may be driven by original equipment manufacturers (OEMs), which wish to use rocker panels of different sizes as well as guide track having different curvatures or sizes as well as minimizing the overall impact of modular system 24 upon the vehicle real estate (e.g., internal compartment) and/or desired weight reductions. Moreover, and through the use of a multiple gear system, the axis of rotation of the rotor 72 or cable drum 40 may also be relocated in order to accommodate size constraints placed upon more drive unit 42.

In addition, and through the use of the multiple gear systems, a larger motor unit may be used with motor drive unit 42 in order to provide a larger driving force (e.g., opening and closing force) to cable drum 40.

Referring now to FIGS. 14-17, an alternative exemplary embodiment of the present invention is illustrated. Here the modular system 24 is configured to be mounted at location of the center roller hinge assembly as opposed to the lower roller hinge assembly. The proposed drive unit of this embodiment will drive off of the center roller hinge and will be located on the center sliding door track. The system will be modular so that all the mechanical components needed for the power sliding door drive unit will be attached to the center track except for the motor and clutch (e.g., the motor drive unit less the cable drum). This allows for an easy slide in assembly sequence for the vehicle assembly line wherein all that needs to be installed from inside the vehicle is the motor drive unit. In this embodiment the center guide track with all of the cables secured and pre-tensioned is secured to the exterior of the vehicle. Thus, no complicated assembly steps are required at the point of installation or at the assembly line as the modular unit with the center roller hinge already attached to the drive cables is merely secured to the exterior of the vehicle and then the motor drive unit (less the cable drum) is secured to the cable drum via an installation process that occurs from within the vehicle. As illustrated, this embodiment is configured such that the motor drive unit will be installed at the rearward end of the guide track. This allows for installation after the guide track is installed in the vehicle because the space needed by the motor in the rear quarter area of the vehicle is minimal thus, the system will protect valuable space in the rear quarter and door and allow the same to be available for other items original equipment manufactures (OEMs) often wish to put in their vehicles.

In this embodiment, the motor drive unit comprises a separate motor/clutch assembly 74 that has an output member 76 which is configured to have a portion received in and engage a cable drum 78 of the modular drive unit. Accordingly, output member 76 will only be driven by the motor if the electromagnetic clutch or other equivalent device is engaged. Accordingly, and in order to allow for free movement of the sliding door, output member will be configured to be rotatably driven when the clutch of the motor drive unit is not engaged.

Figure 14:
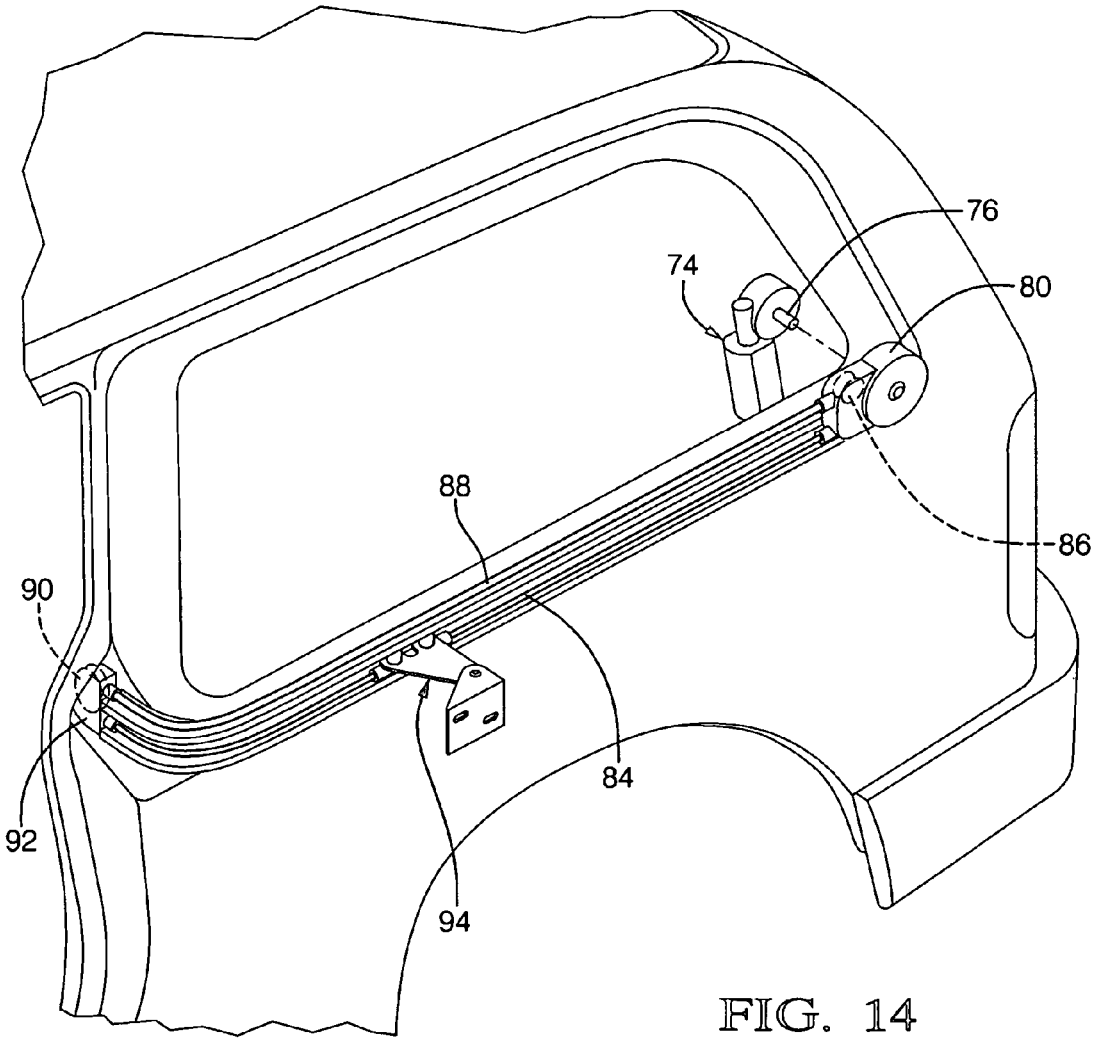
FIG. 14 is a perspective view of a modular power sliding door drive assembly constructed in accordance with another alternative exemplary embodiment of the present invention.

As illustrated in FIG. 14, the power sliding door of this alternative exemplary embodiment is a modular system where all the drive components are attached to the center sliding door track, except for the motor drive unit. Again the system is a cable system wherein all the cables are driven by a single drum, which is integral with the modular unit. Moreover, all of the cables are pre-attached to the hinge assembly prior to installation on the vehicle. Thus, the only other exterior attachment is the securement of the door to the hinge assembly. In this embodiment, the cable drum is rotatably received within a housing 80 disposed at the end of the guide track. Here there are two cables, a front cable 82 and a rear cable 84, which are attached to either side of the cable drum and while one cable raps off the drum the other will rap on thereby allowing movement of the hinge within the guide track. Each cable extends out from the drum towards the front of the vehicle. The front cable first raps around a small pulley 86 and then goes through a front cable conduit 88 along the length of the center roller track to the front pulley.

Figure 15:
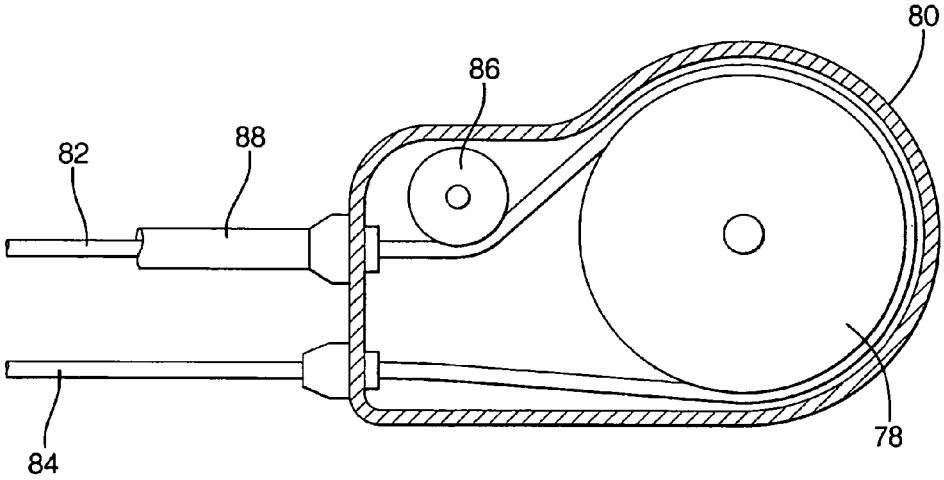
FIG. 15 is a top cross-sectional view of a portion of the FIG. 14 embodiment.

Small pulley 86 is positioned and configured to change the direction of the cable as it wraps off of the cable drum (FIG. 15). At the front of the rack the cable raps around a front pulley 90, which is in a pulley housing 92. Ultimately, the front cable is then secured to a center roller hinge 94 through a tensioner 96. In accordance with an exemplary embodiment tensioner 96 provides approximately 3-4 lbs of force. It is, of course, understood that the force of the tensioners may vary. The rear cable extends between the cable drum and a tensioner 96 of the center roller hinge. In accordance with an exemplary embodiment the diameter of front pulley 90 is 30-33 mm. It is, of course, understood that these dimensions may vary and the present invention is not intended to be limited to the specific dimensions disclosed herein.

Referring now to FIG. 15 the configuration of cable drum housing 80 and cable drum 78 is illustrated. As shown, cable drum 80 is rotatably received within housing 80 and small pulley 86 is positioned to allow the front cable to transition from cable drum 78 into front cable conduit and vice versa. In accordance with an exemplary embodiment the diameter of cable drum 78 is approximately 50-60 mm and the diameter of small pulley is approximately 25-30 mm. It is, of course, understood that these dimensions may vary. In an exemplary embodiment housing 80 is integrally formed with the center guide track, alternatively housing 80 is separately formed and secured to the center guide track by an attachment method such as welding or equivalents thereof. Cable drum 78 and housing 80 are configured on their back side to allow for engagement with the output member of drive unit 74 such that the same can drive cable drum 78 when it is secured to the modular drive unit.

Figure 16:
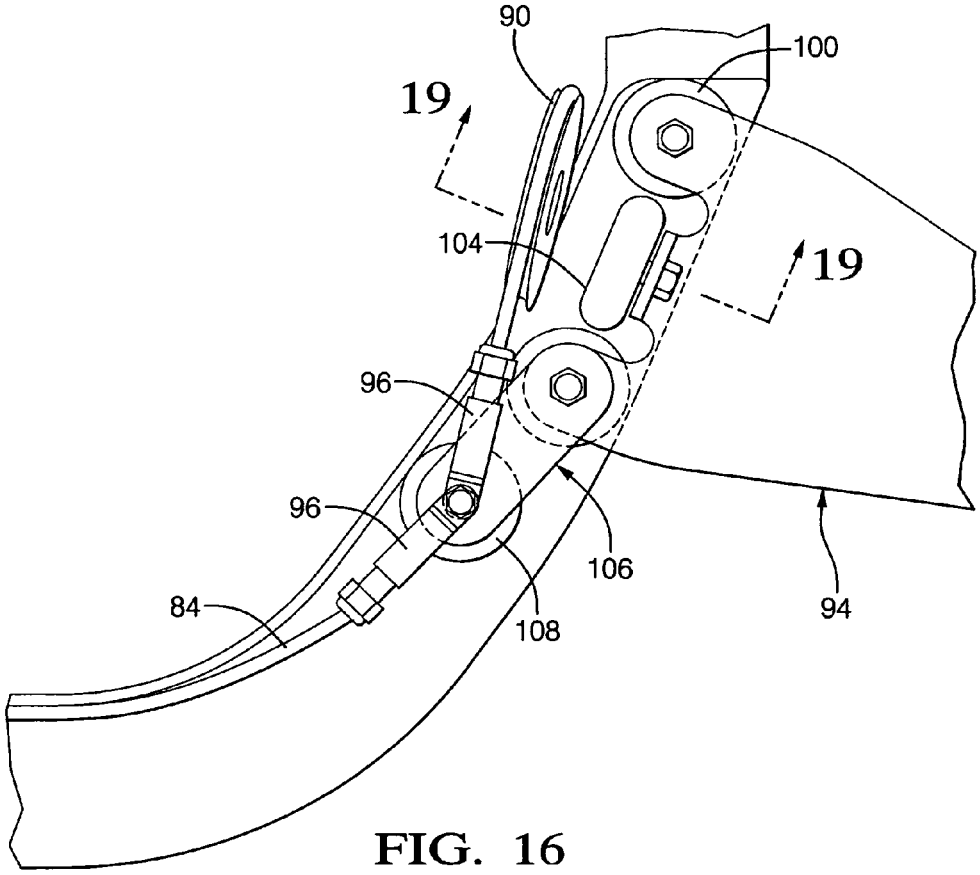
FIG. 16 is top plan view of an alternative exemplary embodiment of the present invention.
Figure 17:
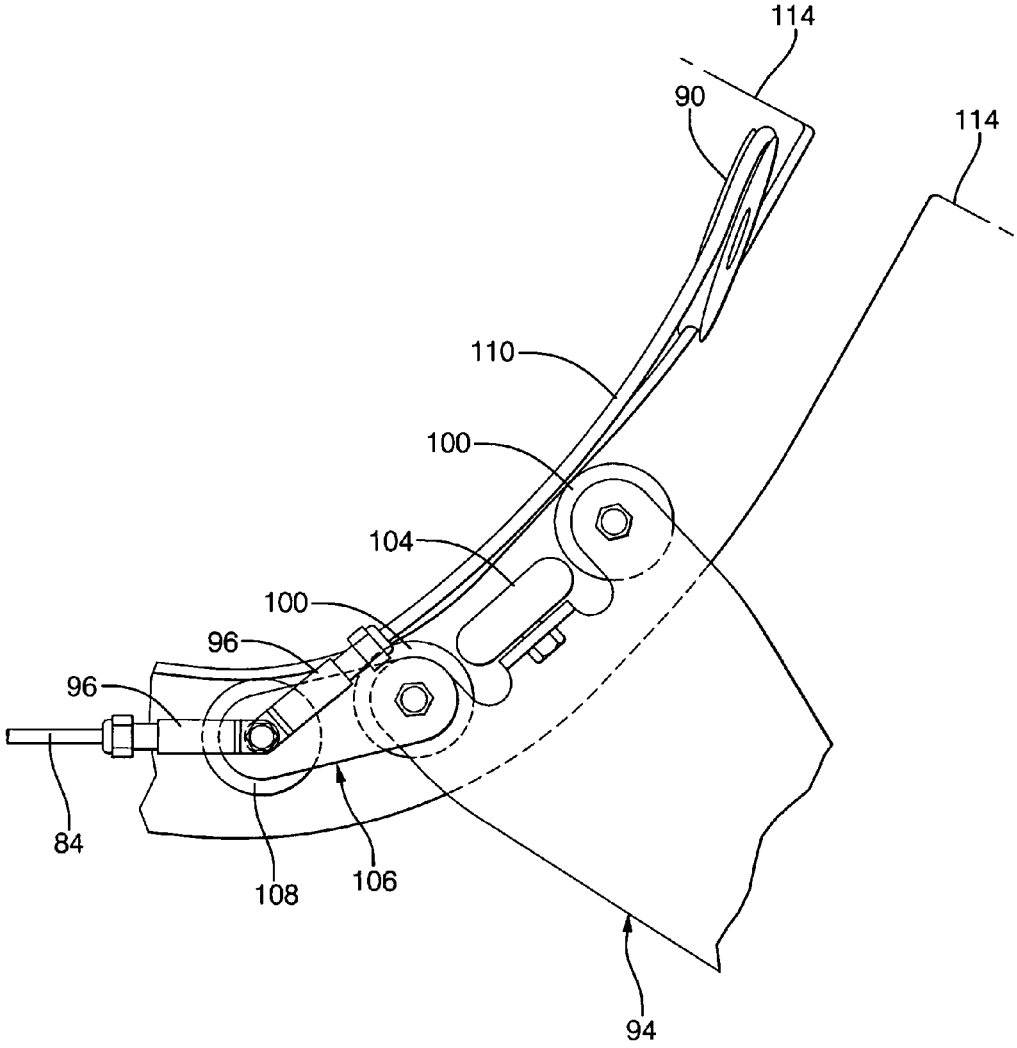
FIG. 17 is top plan view of the FIG. 16 embodiment is a different door closing position.

FIGS. 16 and 17 illustrate a portion of the forward end of the modular center track drive unit. FIG. 16 also illustrates the end of travel of the center roller hinge. It is noted that degree of curvature of the center guide track is larger and the overall length of the curved portion of the center track is shorter when compared to the lower guide track (e.g., longer curved portion and less of a degree of curvature). This is due to the fact that the center guide track bends around the "C" pillar at the end proximate to the door opening while the lower guide track is disposed below the door opening and bends before or behind the "B" pillar thus, the angle of curvature of the lower guide track is able to be less severe which results in a longer curved portion.

As illustrated, the center roller hinge comprises a mounting portion 98 that is secured to a roller assembly 100. Roller assembly 100 is configured to be slidably received within a channel defined by the guide track. As illustrated in FIGS. 16 and 17, roller assembly 100 comprises a pair of rollers 102 rotatably mounted to the roller assembly. Another roller 104 is also rotatably mounted to the roller assembly. Roller 104 has an axis of rotation offset from that of rollers 102. The rollers are configured to allow assembly 100 and hinge 94 to slide within the guide track as the cables are wrapped and unwrapped from the cable drum. It is noted that a similar roller assembly 100 is contemplated for use with the embodiments of FIGS. 2-13. It is also noted that the aforementioned roller assemblies are provided as exemplary examples and alternative means for facilitating the slidable movement of the hinges are contemplated to be within the scope of the present invention.

Referring back now to FIG. 16 and in addition to roller assembly 100, a trailer and roller assembly 106 is pivotally mounted to one end of roller assembly 100. Trailer and roller assembly 106 further comprise a roller 108 for engaging the center guide track as the assembly slides therethrough. The pivotal securement of trailer and roller assembly 106 to roller assembly allows center hinge 94 to travel through the curved portion of the guide track without requiring a larger seal force as the pivotal movement of assembly 106 with respect to assembly 100 allows efficient travel through the curved portion of the track, which corresponds to the area of hinge travel when the door is being closed. This is facilitated by the direct pulling by the portion of the cable that travels around pulley 90 and is secured to the trailer and roller assembly 106. Accordingly, a closing force is applied to hinge assembly 94 at a location, and mounting portion 98. Therefore, pulley 90 is capable of being positioned at the end portion of the guide track in order to facilitate this direct pulling. Moreover, and through the use of the trailer and pulley assembly 106 the cable is capable of pulling at the rear portion of the hinge assembly as it travels through the curved portion of the track prior to the hinge assembly reaching the end of the track or final limit of travel of hinge assembly 94 (e.g., closed-door position). For example, and referring now to FIG. 17, the hinge assembly is located at the curved portion of the guide track and a portion 110 of the cable pulling the door closed via hinge assembly 94 is able to pull on trailer 106 without interference from the guide track. Moreover, the pivotal securement of trailer 106 to member 98 allows cable portion 110 to realign as the hinge assembly travels through the curved portion of the track. In addition, the pivotal movement of trailer 106 with respect to mounting member 98 allows cable 84 to re-align as the assembly travels through the curved portions of the guide track.

Figure 18:
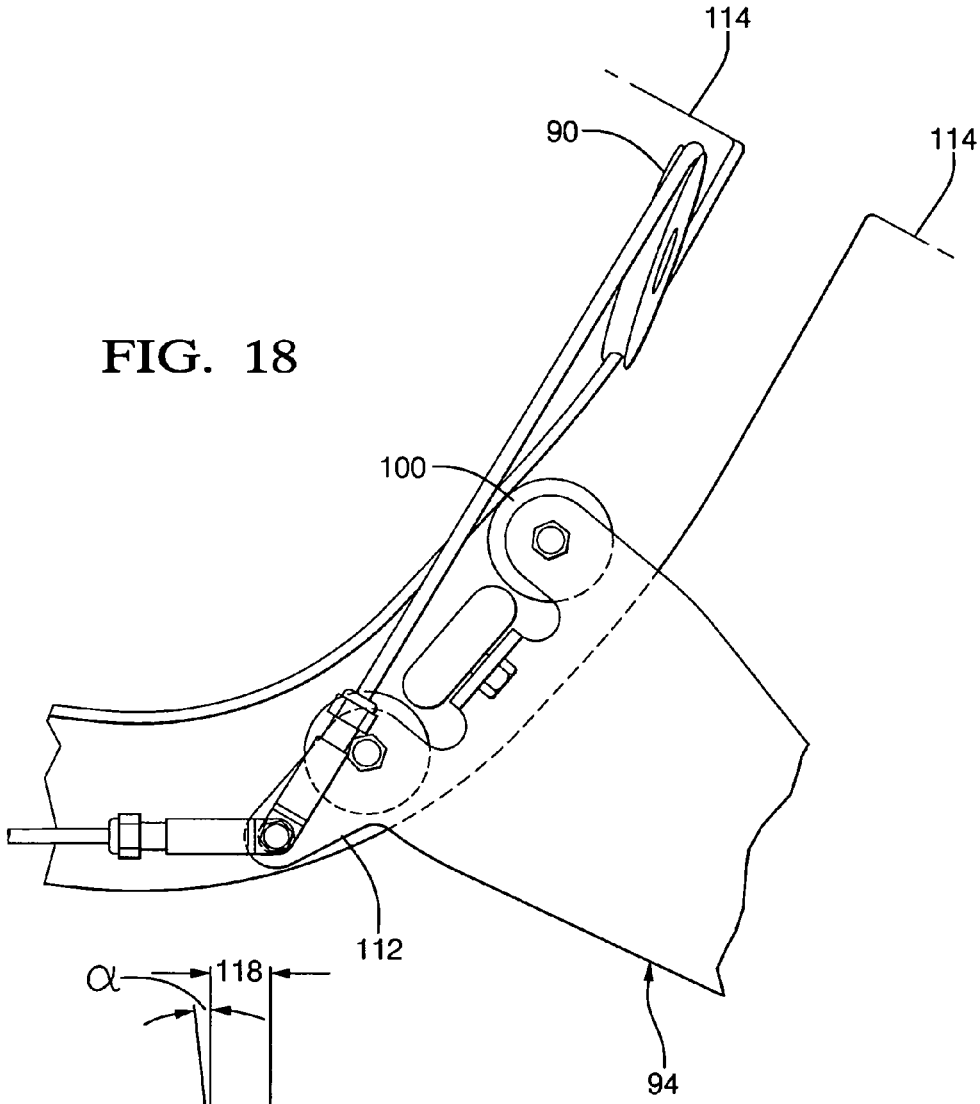
FIG. 18 is top plan view of another alternative exemplary embodiment of the present invention.

Referring now to FIG. 18, another alternative exemplary embodiment of the present invention is illustrated. Here trailer portion 106 is replaced with a protrusion 112, which extends from a portion of mounting member 98. In accordance with exemplary embodiments, protrusion 112 can be integrally formed with mounting member 98 or alternatively secured thereto via a mounting means such as fasteners or welding. As illustrated in FIG. 18, protrusion 112 provides a length sufficient enough to mount the cable thereto, which allows pulley 90 to be disposed at the end of the guide track while also allowing the hinge assembly to travel to the end of the guide track, which corresponds to a closed-door position. This limit of travel of the hinge assembly is illustrated by line 114.

Figure 19:
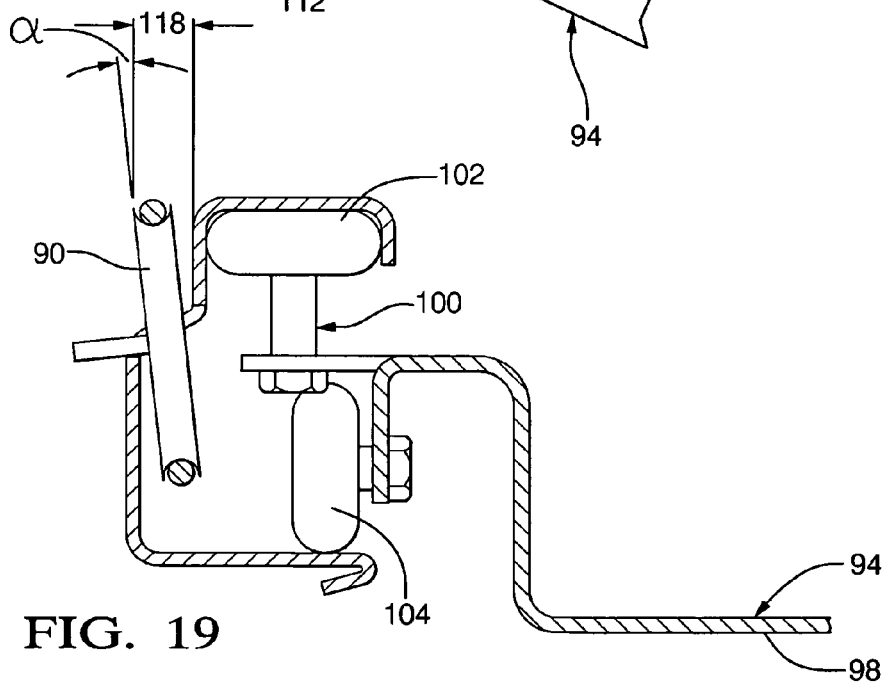
FIG. 19 is a view along lines 19-19 of FIG. 16.

Referring now to FIG. 19, an angular configuration ($\alpha$) and rotational securement of front pulley 90 to the center track is illustrated. This angular configuration relates to the angular configuration of the vehicle body portion disposed about the periphery of the door opening wherein the mid-portion of the door is received therein (see FIG. 14). Also illustrated herein is that roller assemblies 100 and 102 are orthagonally positioned with respect to a path of travel defined by the center track while pulley 90 positioned at a slight angle with respect to assemblies 100 and 102. Orthogonal positioning of the assemblies allows for efficient travel of the rollers within the guide track and angular positioning of pulley corresponds to configuration the door periphery and the portion of the guide track disposed therein. In addition, the angular configuration of pulley 90 allows the same to be rotatably secured in an area having a dimension less than the diameter of the pulley. Accordingly, packaging constraints are achieved through the angular positioning of pulley 90. Moreover, it is also understood that a dimension 118 may vary as angle $\alpha$, which may affect other packaging constraints. Moreover, and in one exemplary embodiment, pulley 90 does not protrude into the vehicle space any more than the width of the center guide track (e.g., width 118 being the same as the width of the track defined by the center guide track). Accordingly, and referring now to FIG. 19, this would allow dimension 118 to be as wide as the guide track to provide a greater angle $\alpha$ with respect to the guide track. It is, of course, understood that the aforementioned angular relationships may vary and the present invention is not intended to be limited to the specific configurations disclosed herein.

With all of these components attached to the center guide track (e.g., a modular unit) it is easy for an operator on the vehicle assembly line to take the entire unit and slide it into the center track area from the outside of the vehicle and attach it with fasteners, as no other mechanical components are required. The operator will then attach the motor/clutch assembly through the inside of the vehicle, slipping the motor shaft in to the cable drum and attaching the motor with fasteners. Moreover, the configuration of the hinge assembly for use with either the center guide track or the lower guide track allows for efficient transfer of forces to the cables driving the system. As discussed above, no cable attachment is require at the point of installation for either the center or lower guide track embodiments.

Figure 20:
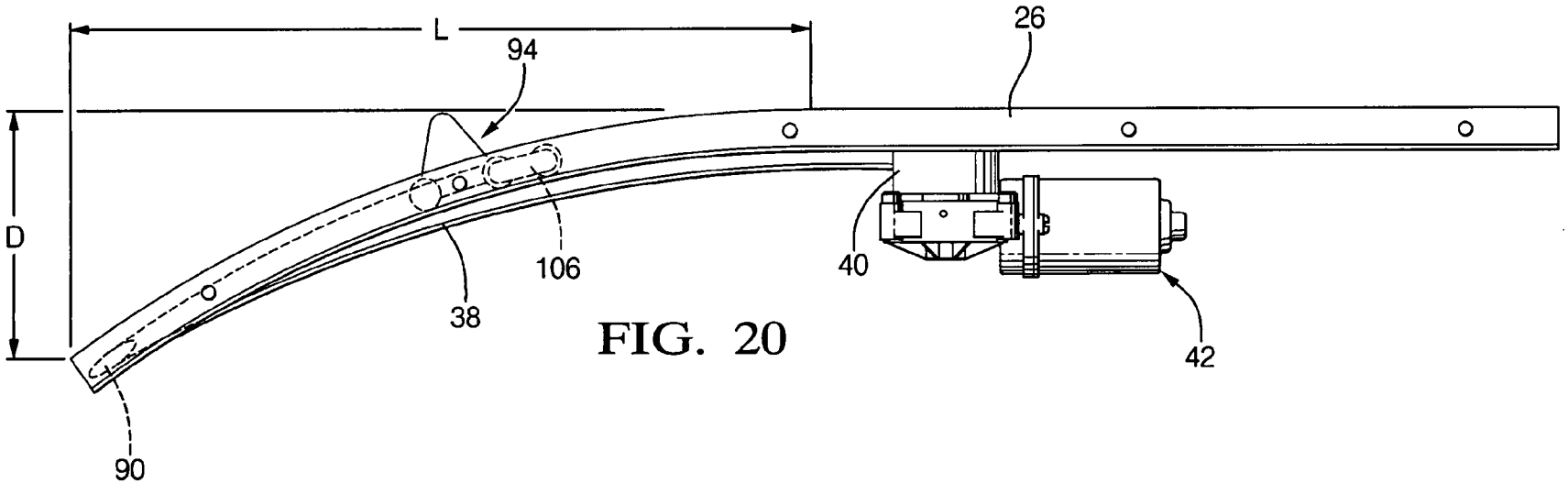
FIG. 20 is top plan view of an another alternative exemplary embodiment of the present invention.

Referring now to FIG. 20, an illustration of hinge assembly 94 with lower guide track 26 is provided. As illustrated, cable 38 is secured to trailer and roller assembly 106. A path of travel of cable 38, from cable drum 40 to pulley 90, without any additional guiding members or means is illustrated in FIG. 20. It is of course understood that cable 38 can be received within a cable conduit as illustrated in FIG. 4 for maintaining cable 38 within the contour of guide track 26 or any other configuration. As illustrated, the length "L" of the curved portion of the track is significantly longer than the length of the curved portion of the center guide track while the dimension "D" is smaller as opposed to the center guide track. A reason for this is that a portion of the lower guide track can be accommodated underneath the door opening along the rocker panel thus, the curvature or curved portion of the guide track is able to configured with the length illustrated in FIG. 20. In other words, the center guide track bends around the "C" pillar at the end proximate to the door opening wherein the lower guide track is disposed below the door opening and bends before or behind the "B" pillar thus, the angle of curvature of the lower guide track is able to be less severe which results in a longer curved portion. It is also understood that the length and degree or arc of the curvature of the curved portion will vary depending on vehicle types, or design and the location of the guide track (e.g., center or lower guide track, for example, some vehicle body types require a shorter length and a greater degree of arc or curvature for a center guide track as opposed to a lower guide track (longer length, smaller degree of arc or curvature).

Figure 21:
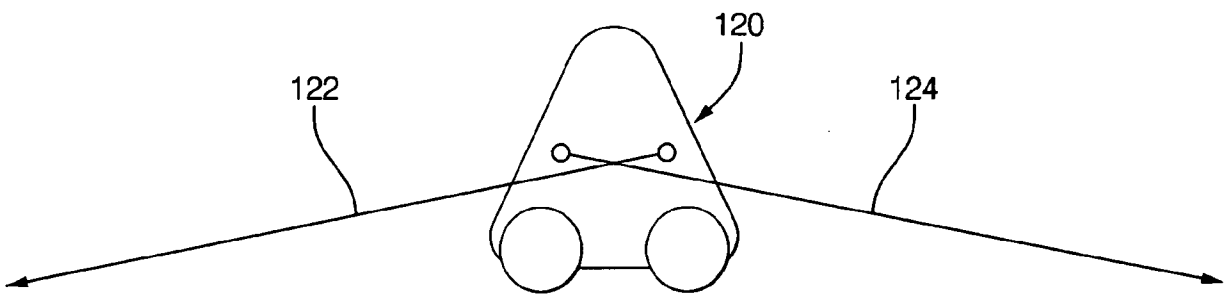
FIG. 21 is top plan view of a hinge assembly of another alternative exemplary embodiment of the present invention.

Referring now to FIG. 21 an alternative cable securement arrangement on a hinge assembly 120 is illustrated. Here in front cable 122 is positioned to pull from a rear portion of hinge assembly 120 when the sliding door is being closed and a rear cable 124 is positioned to pull from a front portion or forward portion of hinge assembly 120 when the sliding door is being opened. Accordingly, the positioning of these cables (122 and 124) allows pulleys to be disposed at either end of the guide track such that the hinge assembly will still be able to travel to the ends of the guide track (e.g., similarly to the arrangement illustrated in FIG. 16). In addition, it is also contemplated that a trailer and roller assembly or protrusion may be used with the cable arrangement illustrated in FIG. 21.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A modular drive assembly for a sliding door, comprising:

a guide track having a hinge assembly slidably received therein;

a pair of pulleys disposed on either end of said guide track, said pair of guide pulleys being disposed adjacent to a path of travel of said hinge assembly within said guide track, said path of travel being defined by a closed door limit and an open door limit; and a pair of cables each having an end that is secured to said hinge assembly and the other end is secured to a cable drum of a motor drive unit mounted to said guide track, said motor drive unit being configured to rotate said cable drum, wherein said cable drum is also capable of freely rotating within said motor drive unit when said motor drive unit is not rotating said cable drum, wherein rotation of said cable drum causes said hinge assembly to move in said guide track as one of said cables wraps onto said cable drum while the other one of said cables wraps off of said cable drum, wherein said hinge assembly passes a portion of one of said pair of pulleys when said hinge assembly is at said closed door limit and said hinge assembly passes a portion of the other one of said pair of pulleys when said hinge assembly is at said open door limit.

2. The modular drive assembly as in claim 1, wherein said guide track comprises a plurality of mounting studs for receipt in a plurality of openings in a structural panel of a vehicle.

3. The modular drive assembly as in claim 1, wherein said structural panel is a lower rocker panel of the vehicle and the guide track is a lower guide track and said modular drive assembly provides an opening and a closing force to the sliding door.

4. The modular drive assembly as in claim 1, wherein said modular drive assembly is secured to a vehicle as a single unit and the guide track is a lower guide track and said modular drive assembly provides an opening and a closing force to the sliding door.

5. The modular drive assembly as in claim 1, wherein said guide track comprises a curved portion, said curved portion corresponding to a portion of a periphery of a door opening in a vehicle.

6. The modular drive assembly as in claim 5, wherein said modular drive assembly is secured to a vehicle as a single unit and the guide track is a lower guide track and said modular drive assembly provides an opening and a closing force to the sliding door.

7. The modular drive assembly as in claim 1, wherein said guide track is configured to provide a lower track of the sliding door.

8. The modular drive assembly as in claim 7, wherein the height of said motor drive unit is no greater than the height of said guide track.

9. The modular drive assembly as in claim 8, wherein said modular drive unit is received with a cavity defined by said guide track.

10. The modular drive assembly as in claim 1, wherein said modular drive unit is received with a cavity partially defined by said guide track.

11. The modular drive assembly as in claim 1, wherein said guide track defines a channel on one side and said motor drive unit is mounted to an opposite side of the guide track.

12. The modular drive assembly as in claim 11, wherein the height of said motor drive unit is no greater than the height of said guide track.

13. The modular drive assembly as in claim 1, wherein said motor drive unit further comprises an electromagnetic clutch for engaging said cable drum to a rotating shaft of a motor of said motor drive unit and said cable drum is a single cable drum.

14. The modular drive assembly as in claim 1, wherein said hinge assembly comprises a roller portion slidably received within a channel of said guide track and a mounting portion pivotally mounted to said roller portion, said mounting portion adapted to be secured to the sliding door.

15. The modular drive assembly as in claim 1, wherein a first conduit is disposed between a housing of said motor drive unit and a housing of one said pair of pulleys and a second conduit is disposed between said housing of said motor drive unit and a housing of the other one said pair of pulleys.

16. The modular drive assembly as in claim 15, wherein a tensioner is disposed between said hinge assembly and said end of each of said cables, said tensioner allows an operative length of said cables to change as said hinge assembly travels within said path of travel.

17. The modular drive assembly as in claim 1, wherein a tensioner is disposed between said hinge assembly and said end of each of said cables.

18. The modular drive assembly as in claim 1, wherein said guide track comprises a plurality of mounting holes for securement of the drive assembly to a vehicle.

19. The modular drive assembly as in claim 1, further comprising:

a first roller assembly secured to said hinge assembly, said first roller assembly being configured to roll in said path of travel; and a second roller assembly pivotally secured to said first roller assembly, said second roller assembly being configured to roll in said path of travel, wherein each of said pair of cables are secured to said second roller assembly.

20. A modular drive assembly for a sliding door of a vehicle, comprising:

a guide track having a hinge assembly slidably received therein, said guide track being configured to provide a center track for the sliding door;

a front pulley disposed on a forward end of said guide track, said front pulley being configured such that said front pulley does not protrude in a door opening of the vehicle any more than a portion of said guide track said front pulley is rotatably mounted to;

a pair of cables each having an end that is secured to said hinge assembly and the other end is secured to a single cable drum of the drive assembly, said single cable drum being located at a rear end of said guide track; and a guide pulley disposed proximate to said cable drum, wherein rotation of said cable drum causes said hinge assembly to move in a path of travel defined by said guide track as one of said cables wraps onto said cable drum while the other one of said cables wraps off of said cable drum, wherein said pulley changes the direction of one of said pair of cables as they wrap off of said cable drum, said path of travel being defined by an open door limit and a closed door limit;

wherein said cable drum is configured to receive a drive portion of a motor drive unit, and wherein the drive assembly is installed on an exterior of the vehicle and said motor drive unit is installed in an interior of the vehicle.

21. The modular drive assembly as in claim 20, wherein said guide track comprises a curved portion, said curved portion corresponding to a portion of a periphery of a door opening in the vehicle.

22. The modular drive assembly as in claim 20, wherein said guide track defines a channel on one side and a motor drive unit is mounted to said cable drum on an opposite side of the guide track.

23. The modular drive assembly as in claim 20, wherein said hinge assembly comprises a roller portion slidably received within a channel of said guide track and a mounting portion pivotally mounted to said roller portion, said mounting portion adapted to be secured to the sliding door.

24. The modular drive assembly as in claim 20, wherein a tensioner is disposed between said hinge assembly and said end of each of said cables, said tensioner allows an operative length of said cables to change as said hinge assembly travels within said path of travel.

25. The modular drive assembly as in claim 20, further comprising:

a first roller assembly secured to said hinge assembly, said first roller assembly being configured to roll in said path of travel; and a second roller assembly pivotally secured to said first roller assembly, said second roller assembly being configured to roll in said path of travel, wherein each of said pair of cables are secured to said second roller assembly.

26. The modular drive assembly as in claim 25, wherein a tensioner is disposed between said second roller assembly and each of said pair of cables.

27. The modular drive assembly as in claim 25, wherein said first roller assembly and said second roller assembly are configured to be orthagonally positioned with respect to a path of travel defined by said guide track and said front pulley is not orthagonally positioned with respect to said path of travel.

28. The modular drive assembly as in claim 20, wherein a tensioner is disposed between said hinge assembly and said end of each of said cables.

29. The modular drive assembly as in claim 20, wherein said guide track comprises a plurality of mounting studs for securement of the drive assembly to the vehicle.

* * * * *